US009070268B2

(12) United States Patent
Monacos et al.

(10) Patent No.: US 9,070,268 B2
(45) Date of Patent: Jun. 30, 2015

(54) WIRELESS SENSOR NODE FOR AUTONOMOUS MONITORING AND ALERTS IN REMOTE ENVIRONMENTS

(71) Applicant: California Institute of Technology, Pasadena, CA (US)

(72) Inventors: Steve P. Monacos, Altadena, CA (US); Anand V. Panangadan, Monterey Park, CA (US)

(73) Assignee: California Institute of Technology, Pasadena, CA (US)

( * ) Notice: Subject to any disclaimer, the term of this patent is extended or adjusted under 35 U.S.C. 154(b) by 16 days.

(21) Appl. No.: 14/068,303

(22) Filed: Oct. 31, 2013

(65) Prior Publication Data

US 2014/0118143 A1 May 1, 2014

Related U.S. Application Data

(60) Provisional application No. 61/720,899, filed on Oct. 31, 2012.

(51) Int. Cl.

| | |
|---|---|
| ***G08B 1/08*** | (2006.01) |
| ***G08B 25/01*** | (2006.01) |
| ***G08B 21/02*** | (2006.01) |

(52) U.S. Cl.

CPC ..... *G08B 25/016* (2013.01); *G08B 21/02* (2013.01)

(58) Field of Classification Search

CPC .. G08B 25/016; G08B 21/02; G08B 21/0258; G08B 21/0261; G08B 21/0269; G08B 21/0277; G08B 21/0283; G08B 21/0286; G08B 21/0288; G01S 5/0054

USPC ..... 340/573.1, 573.4, 539.13, 539.11, 522, 340/539.12, 586, 692, 693.2, 693.1, 693.5; 455/404.1, 404.2; 379/37, 38, 39, 43, 379/45

See application file for complete search history.

(56) References Cited

U.S. PATENT DOCUMENTS

| | | | | |
|---|---|---|---|---|
| 7,330,122 | B2 * | 2/2008 | Derrick et al. | 340/573.1 |
| 7,652,571 | B2 * | 1/2010 | Parkulo et al. | 340/540 |
| 8,599,011 | B2 * | 12/2013 | Schantz et al. | 340/539.13 |
| 2009/0174547 | A1 * | 7/2009 | Greene et al. | 340/539.13 |

OTHER PUBLICATIONS

Gnawali, O., et al., "Collection Tree Protocol", Proceedings of the 7th ACM Conference on Embedded Networked Sensor Systems (SenSys), Berkeley, CA, Nov. 4-6, 2009.

(Continued)

*Primary Examiner* — Anh V La
(74) *Attorney, Agent, or Firm* — Gates & Cooper LLP

(57) ABSTRACT

A method, apparatus, system, and computer program products provides personal alert and tracking capabilities using one or more nodes. Each node includes radio transceiver chips operating at different frequency ranges, a power amplifier, sensors, a display, and embedded software. The chips enable the node to operate as either a mobile sensor node or a relay base station node while providing a long distance relay link between nodes. The power amplifier enables a line-of-sight communication between the one or more nodes. The sensors provide a GPS signal, temperature, and accelerometer information (used to trigger an alert condition). The embedded software captures and processes the sensor information, provides a multi-hop packet routing protocol to relay the sensor information to and receive alert information from a command center, and to display the alert information on the display.

24 Claims, 14 Drawing Sheets

(56) References Cited

OTHER PUBLICATIONS

Hough, G., "Wireless Robotic Communications in Urban Environments: Issues for the Fire Service", MS Thesis, Naval Postgraduate School, Monterey, CA, 2008.

Levis, P., et al., "Dissemination of Small Values", TinyOS Enhancement Proposals, Last accessed: Feb. 10, 2015. http://www.tinyos.net/tinyos-2.x/doc/html/tep118.html.

Remley, K. A., et al., "Wireless Communications in Tunnels for Urban Search and Rescue Robots", Proceedings of the 8th Workshop on Performance Metrics for Intelligent Systems, 2008.

* cited by examiner

WIRELESS SENSOR NODE FOR AUTONOMOUS MONITORING AND ALERTS IN REMOTE ENVIRONMENTS

CROSS-REFERENCE TO RELATED APPLICATIONS

This application claims the benefit under 35 U.S.C. Section 119(e) of the following co-pending and commonly-assigned U.S. provisional patent application(s), which is/are incorporated by reference herein:

Provisional Application Ser. No. 61/720,899, filed on Oct. 31, 2012, by Steven P. Monacos and Anand V. Panangadan, entitled "Wireless Sensor Node for Autonomous Monitoring and Alerts in Remote Environments".

STATEMENT REGARDING FEDERALLY SPONSORED RESEARCH AND DEVELOPMENT

The invention described herein was made in the performance of work under a NASA contract, and is subject to the provisions of Public law 96-517 (35 USC 202) in which the Contractor has elected to retain title.

BACKGROUND OF THE INVENTION

1. Field of the Invention

The present invention relates generally to tracking people/nodes, and in particular, to a method, apparatus, system, and article of manufacture for low-power wireless nodes that provide tracing of the position of the nodes.

2. Description of the Related Art (Note: This application references a number of different publications as indicated throughout the specification by reference numbers enclosed in brackets, e.g., [x]. A list of these different publications ordered according to these reference numbers can be found below in the section entitled "References." Each of these publications is incorporated by reference herein.)

The current radio infrastructure for wild land firefighter personnel provides voice communications but does not support data transfer capability for continuous monitoring of personnel in the field. Current radios require user interaction to perform manual voice check in for firefighter status. A new infrastructure is required to enable continuous, autonomous monitoring of firefighter personnel during a firefight via a remote command and control center. The system additionally needs to provide the capability to send 2-way alerts to provide early warning of impending danger to personnel in real-time and for indication of an emergency in the field due to a downed firefighter(s). To better understand such problems, a description of prior art tracking requirements and systems may be useful.

Preserving the safety of first responders in the field is of utmost importance. One component of safety systems attempts to track the location of first responders along with attempting to provide alerts both to and from such first responders. Unfortunately, prior art tracking systems often fail and/or are unable to determine the location of a first responder. In view of the above, as used herein, first responders include firefighters (e.g., wild land firefighters in forest fire environments), forest services, urban search and rescue groups, etc. In addition, it may be useful to track other persons such as soldiers in the field, hikers, mountain bikers, animals (e.g., tagged mountain lions, bears, etc.), etc. However, many environments (in which it is desirable to track such persons/animals) have a vast area, a lack of infrastructure, and very rough terrain. Further, it is desirable to track such persons/animals based on standard (fire fighter) supplies such as AA batteries, while also visualizing the person/animal location on a map-based display, along with the ability to receive alerts from such persona and send messages back to such persons via a graphical user interface.

One prior art radio based system is the Geospatial Location Accountability and Navigation System for Emergency Responders (GLANSER™). Glanser™ is designed for indoor applications, is carried on a firefighter, and consists of a radio, a battery (e.g., AA), and a suite of navigation devices for embedded tracking Two-way signals are transmitted at 900 MHz frequency by a USB-powered base laptop station in a fire truck to monitor firefighters.

Another prior art system is the Physiological Health Assessment System for Emergency Responders (PHASER™). Phaser™ monitors a firefighter's body temperature, blood pressure, and pulse. An alarm sounds on a laptop if the firefighter is in trouble and the location can be found via Glanser™.

A further prior art system is the Wireless Intelligent Sensor Platform for Emergency Responders (WISPER™). Wisper™ is a 1-inch-square, ½-inch thick, throwaway router that contains a two-way digital radio, antenna and 3-volt lithium cell. The routers form an ad-hoc mesh network. However, such routers are relatively short range and are designed to work indoors.

Further prior art systems include satellite-based communication systems. Such systems require high power transmitters that consume power. Accordingly, the continuous transmission of data in such systems is not practical. For example, the Delorme™ InReach™ system has a maximum update rate of about two minutes. The Delorme™ InReach™ system also designates delivery (of up to three pre-loaded messages) to email, cell phones, Facebook™, or Twitter™ and sends an SOS with the GPS location (with delivery confirmation received for all messages via LED). The Delorme™ systems provides the ability for others to track a person's progress online for mutual peace of mind. However, Delorme™ systems require user interaction and the use of a satellite link can result in a permanently obstructed signal due to rubble (regardless of proximity). In addition, transmitting large amounts of sensor data also consumes power. Hence, adding sensors is difficult. Further, clear line-of-sight to the sky is required for satellite-based communication. Consequently, no communication is possible if there is an obstruction, even if there is a nearby node.

In view of the above, it is desirable to have a system that has robust data relay between persons (e.g., first responders)/animals and a command center along with two way alerts and warning on incident command systems. Such capabilities are not currently available in traditional wild land firefighting radios. In addition, it is desirable to have a low power design that utilizes a wide range of sensors (e.g., environmental parameters and GPS location). Further, it is desirable to provide a visualization of person/animal locations on a map-based display with the ability to receive alerts from persons and send messages back to such persons from the graphical user interface.

SUMMARY OF THE INVENTION

Prior art radios used by firefighters provide for voice communications but do not support the capability for data handling or to monitor the movements and status of firefighters while in the field fighting fires. Due to the lack of such a communications infrastructure in such remote environments, embodiments of the invention provide an autonomous wireless sensor network (referred to as the personal alert and tracking system (PATS)) for tracking first responders (e.g., firefighters) operating in the field (e.g., wild land fire environments) with minimal intervention by the first responders.

PATS consist of a networked collection of custom-designed low-power wireless nodes that provide tracking of the position of the nodes. A PATS node is capable of transmitting sensor information and receiving visual/audible alerts and warnings over an extended rugged area. The nodes are equipped with onboard GPS, temperature, and accelerometer sensors with the ability to interface additional sensors as needed to each node. Mobile nodes form arbitrary network topologies and use a multi-hop packet routing protocol to relay sensor data to the command center. The multi-hop capability enables robust communication in a variety of environments by routing around natural and man-made terrain features. PATS nodes are capable of communication over several kilometers with burst rates of tens of kilobits per second. Embedded software on each node captures, processes and routes sensor data through the PATS network and displays alert information to the person carrying the node.

In view of the above, embodiments of the invention includes multiple sensor nodes, a base station node, and a graphical user interface (GUI). The sensor nodes and base station may use the same hardware but with minor variations to accommodate the different functionality. Additionally, the software utilized by the sensor and base station nodes may be different to accommodate the functionality specific to each node type. The PATS network is accessed through a web-based GUI (referred to as Situational Awareness and Prediction [SAP]), that is a client-server based application to provide web-based capability.

The wireless, small-forum node includes integrated sensors as part of an ad-hoc wireless mesh network to collect real-time telemetry from the sensor of the node. The node also incorporates a user interface for receiving audible and visual alerts and sending an alert signal when an emergency situation occurs. The node incorporates spatial and frequency hopping capability with periodic updates of the local network topology to allow for rerouting of telemetry data and alerts as the network topology changes due to movements of the nodes and/or nodes being powered up or down. Telemetry data from the network is ultimately sent to a remote command center via a long distance repeater link and/or internet connection to a web-based server for personnel status and to broadcast alerts back to the nodes for impending dangerous conditions requiring immediate action.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

Figure 1:
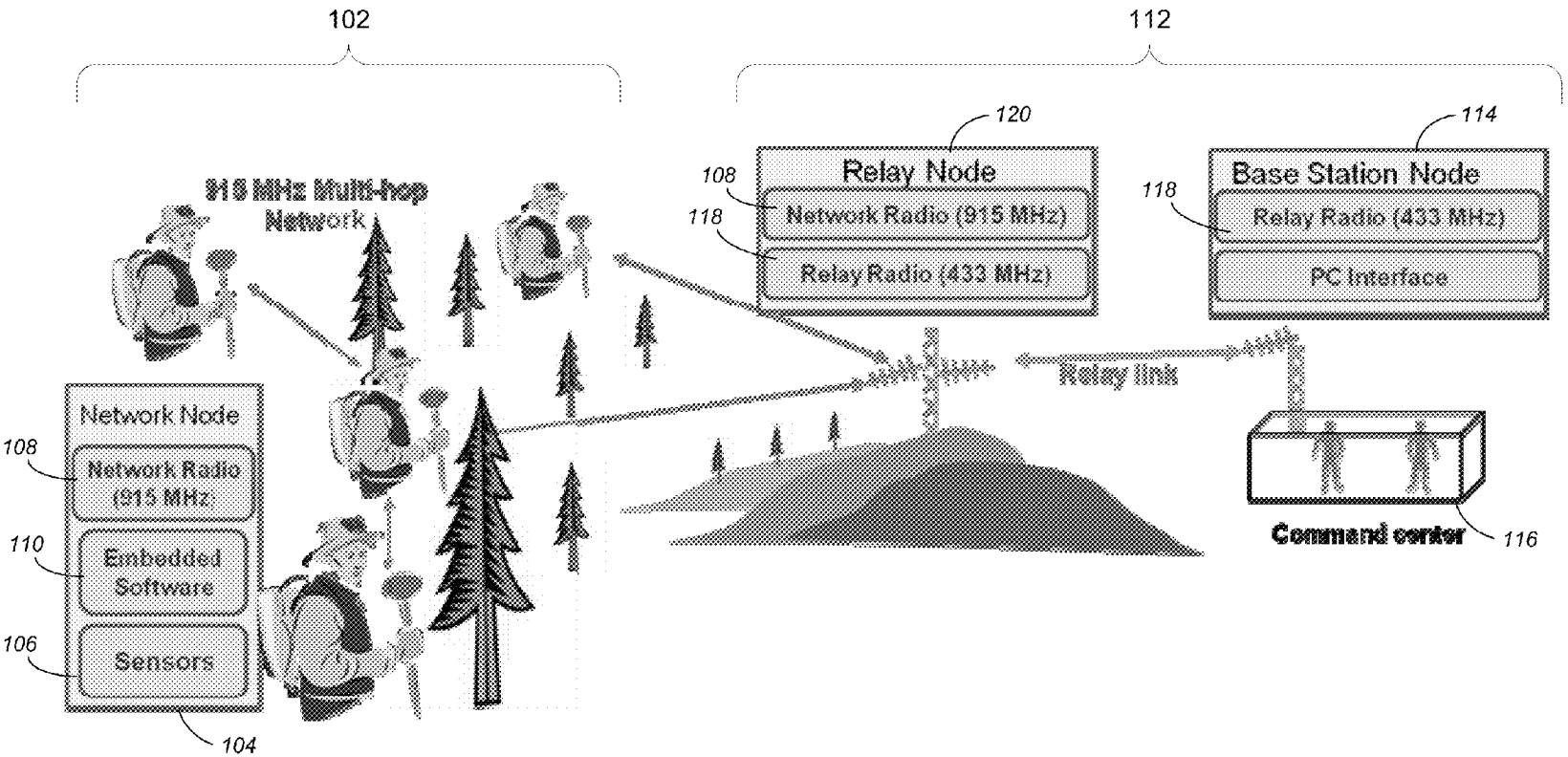
FIG. 1 illustrates an exemplary PATS multi-tier communication architecture utilized in accordance with one or more embodiments of the invention.

In the following description, reference is made to the accompanying drawings which form a part hereof, and which is shown, by way of illustration, several embodiments of the present invention. It is understood that other embodiments may be utilized and structural changes may be made without departing from the scope of the present invention.

Overview

A Personal Alert and Tracking System (PATS) consists of a networked collection of custom-designed low-power wireless nodes that provide tracking of the position of the nodes. A PATS node is capable of transmitting sensor information and receiving visual/audible alerts and warnings over an extended rugged area. The nodes are equipped with onboard GPS (global positioning system), temperature, and accelerometer sensors with the ability to interface additional sensors as needed to each node. Mobile nodes form arbitrary network topologies and use a multi-hop packet routing protocol to relay sensor data to the command center. The multi-hop capability enables robust communication in a variety of environments by routing around natural and man-made terrain features. PATS nodes are capable of communication over several kilometers with burst rates of tens of kilobits per second. Embedded software on each node captures, processes and routes sensor data, and displays alert information to the person carrying the node.

PATS integrates several different technologies to implement a system that is capable of relaying information between widely distributed entities such as between frontline wild land firefighters and remote command centers. PATS nodes may be mobile and the mesh networking technology is able to autonomously route data via a self-organizing network. The PATS node hardware design integrates all processing, sensing, communication, and display components into one device. The hardware design is extensible and headers are available for interfacing with external sensors and radios.

In particular, embodiments of the invention provide a design that includes two radio transceiver chips that enable operation at two different frequency ranges—902-928 MHz ISM band and 400 MHz licensed band. These two radios enable the same hardware device to operate as either a mobile sensor node or a relay base station. The PATS node includes a RF (radio frequency) power amplifier that enables a line-of-sight communication range of 2 km between two nodes in the 902-928 MHz frequency range.

FCC (Federal Communications Commission) regulations limit the amount of continuous power that can be transmitted in one channel to 1 mW or less (FCC Part 15, 15.247). To operate at higher powers, PATS implements frequency hopping so that communication in each band is limited to 40 ms duration as required by the FCC regulations. The time synchronization needed to maintain the time slots of the distributed sensor nodes for frequency hopping is provided by the GPS signal. Thus, PATS integrates the spatial multi-hopping protocol (Collection Tree Protocol) with the frequency hopping protocol to provide a spatial multi-hopping system with 2 km range at each hop. PATS can operate without the frequency hopping mechanism; in this case, the transmit power may be limited to 1 mW (for a few hundred meters range at each hop).

System Architecture

Embodiments of the invention provide an ad-hoc wireless sensor network with the following functionality:

- 2D tracking and visualization of first responders (e.g., wild land firefighters) with 2-way alerts and warning on incident command systems not currently available with traditional wild land firefighting radios;
- A robust sensor web to relay information between front line wild land firefighters and the incident command center; and
- A sensor web design using a 2-tier system where Tier 1 is the firefighter mesh network and Tier 2 is the first level command-control.

Such functionality is achieved using sensor and base station nodes.

Sensor nodes have the following features:

- Embedded code to collect data from onboard accelerometer, temperature and GPS sensors;
- User interface includes a 1"×1" Organic Light Emitting Diode (OLED) text display and LED with buzzer for audible/visual alerts;
- Local ad hoc network operation in the 915 MHz Industrial, Scientific and Medical (ISM) band; and
- Small handheld sensor node measuring 5"×3.1"×1" (excluding antenna) and weighing less than ½ kg.

Base station nodes may have the following features:

- Small handheld node measuring 5"×3.1"×1" (excluding antenna) and weighing less than ½ kg;
- Connects to a laptop/PC and has embedded code to collect network data and transmit text/alerts to the network;

Laptop bridge code may be used to interface a laptop computer to the base station node.

Further, a web-based Graphical User Interface (GUI) may be used to monitor sensor nodes and send alerts to the nodes to relay emergency conditions FIG. 1 illustrates an exemplary PATS multi-tier communication architecture utilized in accordance with one or more embodiments of the invention.

Tier 1 102 is a local first responder (e.g., firefighter) group with dynamic multi-hop routing. More specifically, tier 1 102 consists of the 915 MHz multi-hop network with direct communication between the sensor nodes 104 carried by the first responders (e.g., firefighters) in the field to collect telemetry/alerts and disseminate commands to other nodes. Tier 2 112 includes the 433 MHz relay link 118 and remote command center 116 with the GUI for monitor and control of the tier 1 network 102.

More specifically, tier 1 102 consists of an ad-hoc mesh network of PATS nodes 104 (also referred to as network nodes). A PATS node 104 is a portable device with sensors 106, radios 108, microcontroller, and embedded software 110. The first responder units/network nodes 104 provide for multi-hop routing (space/frequency) of sensor data to a relay node 120. The relay radio 118 transfers information from the multi-hop network using a longer range dedicated point-to-point communications path to a distant incident command center 116.

The nodes 104/120 can autonomously self-organize in to a multi-hop network 102 and relay sensor data to a Base Station Node 114 e.g., via relay node 120). The distance between each pair of nodes 104/120 can be up to 2 km between first responders for line-of-sight communication. The ad hoc routing accommodates random first responder movements and an arbitrarily large extent of first responder groups. The obstructions between first responders are circumvented by a dynamic multi-hop protocol. Mesh networking at Tier 1 102 is conducted in the 902-928 MHz radio frequency range.

Tier 2 112 is a long distance (tens of km) repeater network to a command center 116. The relay radio 118 (within a relay node 120) can transfer information from the multi-hop sensor network 102 using a longer range, dedicated point-to-point communications path to a distant incident command center 116. Radio communication at 433 MHz will potentially be used for long-range relay link.

Accordingly, tier 1 102 and tier 2 112 work together to provide communication between first responders in the field and a command center 116. At Tier 1 102, ad-hoc mobile multi-hop networking is used to collect sensor data from the handheld units and forward them to a central base station node 114. Multi-hop networking is also used to forward text messages from the base station 114 to selected or all handheld units 104. Multi-hop communication is necessary in a web-enabled sensor network when an embedded sensor node 104 is out of range of the nearest communication node with web access. In such cases, the sensor data should be routed via intermediate embedded sensor nodes (e.g., network nodes 104 or relay nodes 120). In such a scenario, the spatial extent of the sensor web is limited only by number of intermediate nodes (where the range is the number of hops times the radio range of a single sensor node).

Figure 2:
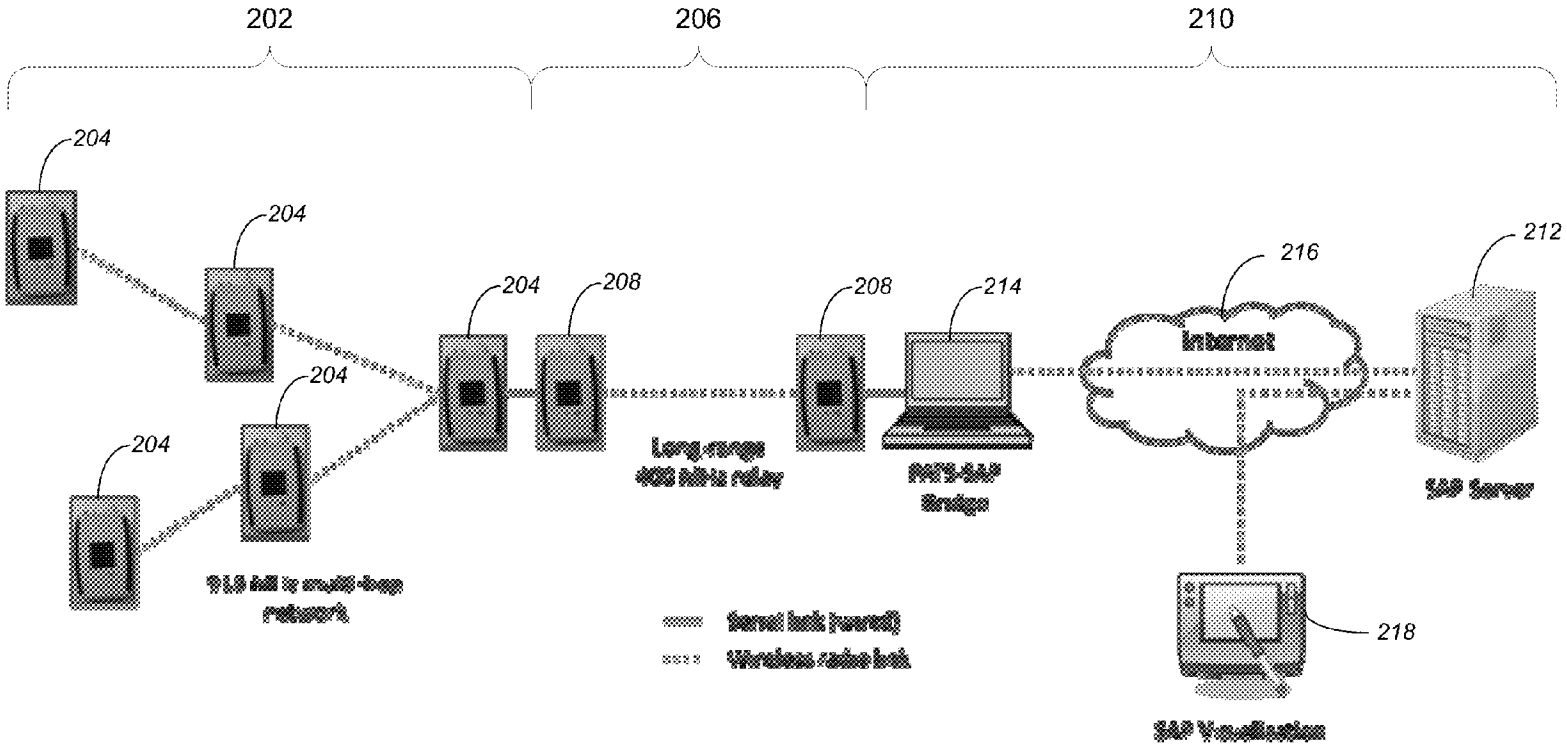
FIG. 2 illustrates a different viewpoint of the communication architecture of PATS in accordance with one or more embodiments of the invention.

FIG. 2 illustrates a different viewpoint of the communication architecture of PATS in accordance with one or more embodiments of the invention. FIG. 2 shows the end-to-end communication design of the PATS system. Data from the first responders passes through multiple levels before it reaches the graphical user interface.

In a multi-hop communication level 202, data originates from the sensors on the network nodes 204 carried by the first responders and is dynamically routed through other nodes 204 using wireless communication to reach a base station. The base station can also send text messages back to individual network nodes 204 using multi-hop routing.

A second level is that of long distance communication 206. At level 206, all of the sensor data from the first responders (i.e., network nodes 204) is transmitted between two base stations over a long distance (e.g., tens of km) using a pair of relay radios 208.

A third level is that of the PATS-SAP bridge 210. At level 210, all of the data from a basestation is transformed into the format expected by the SAP server 212 (e.g., via a computer 214) and then transferred to the server 212 over the internet 216. The data may then be visualized on a web browser or other presentation device 218. Such a web browser or presentation software may be executing on a hand-held computer such as a tablet computer. The browser 218 communicates with the SAP server 212 over the Internet 216 to show only the data requested by a user.

Multi-Hop Communication

Multi-hop routing is necessary when a sensor/network node 104/204 is out of range or out of line-of-sight of the base station 114. In this case, data is routed via intermediate sensor nodes 104/204. The range is thus limited only by the number of intermediate nodes 104/204. The multi-hop routing protocol automatically re-route data as nodes 104/204 move and new sensor nodes 104/204 may join the network 102/202 at any time. Thus, dynamic multi-hop routing of data between sensor nodes 104/204 enables routing around obstructions, accommodates random firefighter movements, and scaling to large number of firefighters.

PATS uses the Collection Tree Protocol (CTP) [1] as the multi-hop routing methodology for moving sensor data from the PATS nodes 104/204 to the base station 114. In this methodology, data from all sensor nodes 104/204 in the network 102 is forwarded to a sink node, which in the case of PATS is a single base station node 114 (or a pre-defined set of base station nodes 114). CTP is a tree-based routing protocol, where each remote node 104/204 keeps track of which of its neighboring nodes 104/204 is closest to the base station 114. A remote node 104/204 then sends out packets through this neighbor. Nodes 104/204 thus form a routing tree to the sink node 114. CTP is called an address-free protocol as all packets move toward the sink node 114 by choosing only the next hop. Nodes 104/204 generate routes to the sink 114 using a routing gradient.

The CTP uses link quality estimates provided by the radio (while sending and receiving packets) to determine how close neighboring nodes 104/204 are. Thus, CTP uses link quality estimates provided by the radio transceiver to determine how close neighboring nodes are. The link quality is obtained while sending and receiving packets. Each sensor node 104/120 keeps track of which of its neighboring nodes is closest to the base station 114 and data packets are sent out though this neighbor (this defines the next "hop"). CTP also enables route discovery and thus the sensor network can automatically adapt to changes in node layout. It can automatically reroute data as nodes are moved and new sensor nodes can join the network at any time.

CTP is a best effort protocol (i.e. it does not guarantee 100% reliable delivery). However, CTP has several mechanisms to improve delivery reliability. High packet delivery/receipt rates (90-99.9%) have been observed in test-beds with over 100 nodes 104/204. The CTP protocol may be implemented in the TinyOS™ operating system (the embedded operating system that runs on the PATS sensor nodes 104/204 and base station node 114).

Multi-hop communication is also used to send alert messages from the command center 116 back via the base station 114 to individual PATS sensor nodes 104/204. The selected protocol for distributing alert messages is the default dissemination methodology [2] distributed with the TinyOS™ operating system. The methodology distributes "small" values to all nodes, where "small" denotes that data must fit within one packet. This corresponds to a payload of twenty (20) bytes. The alert message will include the destination ID; only nodes with the corresponding ID will display the alert message. Thus, the dissemination routing methodology [2] may be used to distribute text messages to a set of selected sensor nodes. The dissemination methodology is the converse of the Collection methodology (CTP) that is used to route sensor data packets to the base station 114. The dissemination methodology is a flooding method in that no route information is maintained at (any of the) nodes 104/204. A complete point-to-point routing protocol (e.g., a Tymo methodology that may be implemented in TinyOS™) may also be used.

The multi-hop communication may also use a TI (Texas Instruments) CC1101 transceiver and TI CC1190 RF power amplifier on the PATS node. The line-of-sight range between two PATS nodes is approximately 2 km when the transmission power is 0.5 W.

In view of the above, embodiments of the invention utilize the CTP as the multi-hop routing protocol to route data packets from sensor nodes 104/204 (carried by first responders) to a single data collection node 208, which will then relay all data over a long-range link to the central observation location. The throughput of the CTP protocol is characterized as the number of sensor nodes 104/204 increases and various system parameters and operational conditions are changed. These parameters and conditions may include:

1. Communication topology of the nodes 104/204: Depending on the geographic location of the nodes 104/204 and the radio communication range, the connectivity between nodes 104/204 will vary;
2. Size of data packet: Depends on the amount of sensor information to be transmitted and routing protocol overhead;
3. Data rate: The data rate determines the proportion of bandwidth consumed by transmitting one packet. This determines contention for the common access communication medium; and
4. Data transmission frequency: This parameter determines how often data packets have to be moved from the sensor node to the data collection node. This parameter, together with the data rate, determines contention for the common access communication medium.

Sensor network simulation software may be used to model the specifics of the CTP routing protocol in a variety of configurations. Such software may include an advanced channel model based on empirically measured data. This model accounts for temporal variation of path loss and interference. The radio model may be based on real radios for low-power communication. The probability of reception is based on SNR (signal to noise ratio), packet size, and modulation type (PSK [phase shift keying] or FSK [frequency shift keying]). Nodes can also be mobile. The CTP model may be defined for the CC2420 radio which has a fixed bitrate of 250 kbps and operates at 2.4 GHz. PATS may also use the CC1101 radio at 915 MHz and has a higher output power. The appropriate CC1101 radio parameters may be programmed into a simulator and the path loss may be changed from 2.4 GHz to 915 MHz.

Simulation parameters may be set such that the radio communication range is set to 1000 m with an ideal modulation scheme (i.e., without a time-varying noise component). To conduct a simulation, up to 50 nodes may be deployed in one of three configurations: a compact configuration, a grid configuration, and a row configuration.

Figure 3:
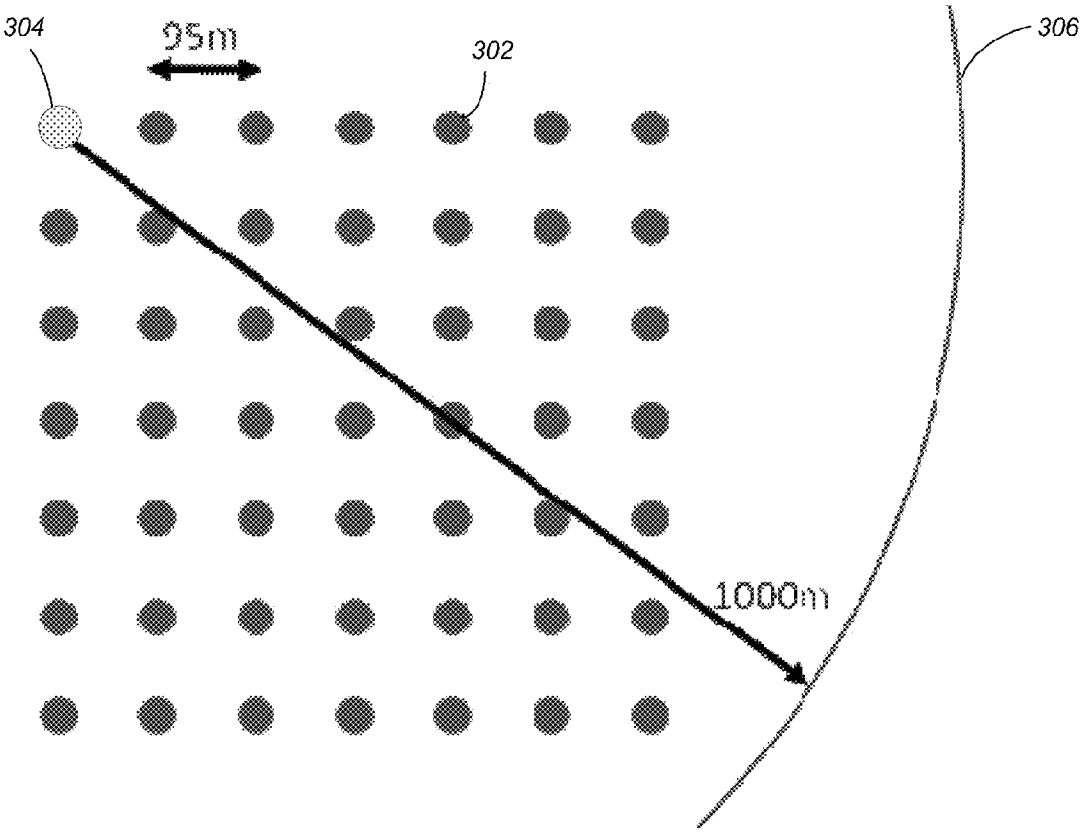
FIG. 3 illustrates a compact configuration of the PATS nodes in accordance with one or more embodiments of the invention.

FIG. 3 illustrates a compact configuration in accordance with one or more embodiments of the invention. In the compact configuration, all (sensor) nodes 302 were within direct radio communication range of the data collection node 304. In this configuration, all the transmitting nodes directly contend for a single common access medium. The arc 306 shows the range of the data collection node's 304 radio (encompasses all of the sensor nodes).

Figure 4:
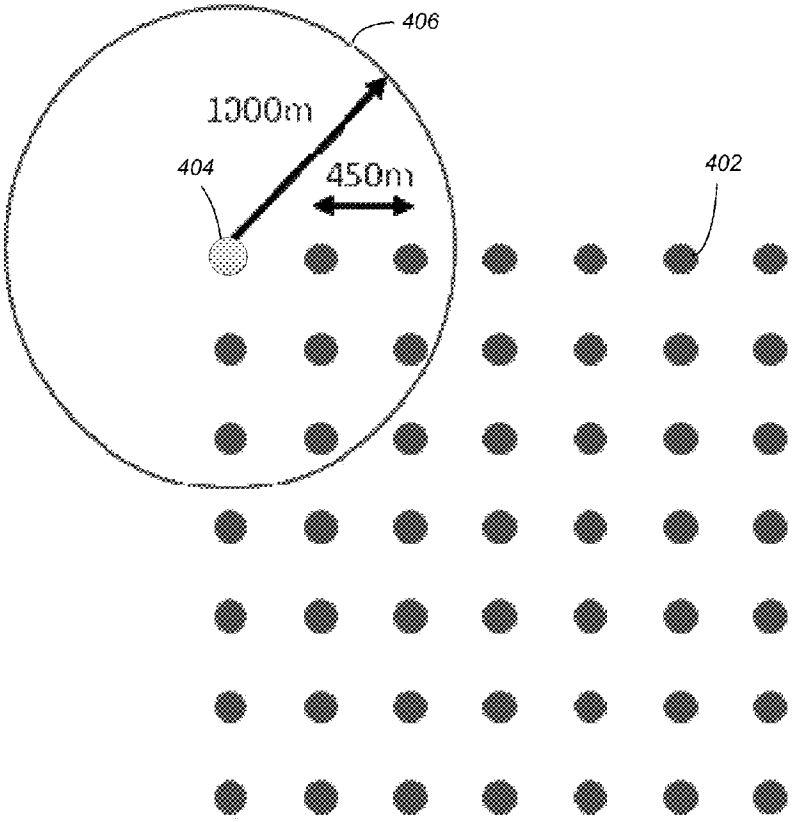
FIG. 4 illustrates a grid configuration of the PATS nodes in accordance with one or more embodiments of the invention.

FIG. 4 illustrates a grid configuration in accordance with one or more embodiments of the invention. In the grid configuration, the (sensor) nodes 402 are arranged in a grid with cell distance set to 450 m. Each node 402 can directly communicate with only a subset of the sensor nodes 402 (i.e. those within 1000 m of its position) and multi-hop communication is required to move data from distant nodes 402 to the data collection node 404. The circle 406 centered at the data collection node 404 shows the range of its radio.

Figure 5:
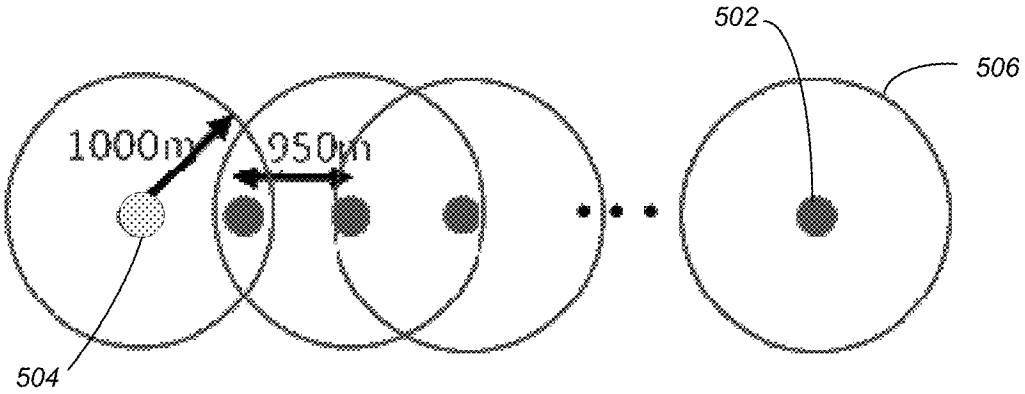
FIG. 5 illustrates the row configuration of the PATS nodes in accordance with one or more embodiments of the invention.

FIG. 5 illustrates the row configuration in accordance with one or more embodiments of the invention. In the row configuration, the nodes 502-504 are arranged in a row with the data collection node 504 at one end and the inter-node distance set such that each sensor node 502 can communicate to only the two nodes on either side of it. The circles 506 show the range of each node's radio.

Long Distance Communication

Commercial FreeWave LRS455 radios 208 may be used in the field for the long-range relay 120/206 between the multi-hop network base station node 114 and an Internet-accessible computer that acts as the PATS-SAP bridge 214. A pair of LRS455 radios, operating in the 435-465 MHz industrial band, inserted between the PATS base station node 114 and a laptop 214 running the bridge code can communicate telemetry data/control between the PATS network and the SAP server 212 over an extended range (up to 70 miles). Such a setup may require a 3.3V UART to RS-232 adapter with null modem to connect the PATS base station node 114 to one LRS455 radio, and a serial to USB adapter to connect the second LRS455 radio to a laptop. The LRS455 radios may be programmed to operate in a Master-Slave configuration. The serial ports of the LRS455 radios may be reprogrammed to communicate at 115 kbps instead of their default 19.6 kbps. Such a setup can be used to reliably relay data from a PATS sensor node 104/204 to the PATS base station 114 through the Freewave™ radios and into the laptop 212 running the PATS-SAP bridge code.

The 433 MHz onboard radio on the PATS node board can also be used to set up a similar point-to-point link. However, some designs may only allow one-way communication from a PATS multi-hop base station 114 to the bridge laptop computer 214. In such a configuration, a pair of PATS nodes 104/204 that are programmed to operate their 433 MHz CC1101 radios is used as the relay link. This type of connection requires that the 915 MHz base station 114 be connected to the 433 MHz relay node 120 via a crossover UART cable.

PATS-SAP Bridge

A PC 214 equipped with a USB port and a connection to the Internet 216 is used to transfer data between the multi-hop PATS network 202/206 and the Internet-based SAP visualization and control software 218. The bridge PC 214 is connected to the PATS base station node 208 via a USB-serial cable. Bridge software executes on the bridge PC 214. The bridge software reads the bytes coming over the serial link, interprets the bytes as sensor measurements, and then relays them over a TCP (transmission control protocol) channel to the remote SAP server 212.

Data Formats

The bridge code will initiate a TCP connection to the SAP server 212. The connection will be full duplex to send sensor data from the bridge software and receive text messages from the GUI 218. The TCP connection is left open for the duration of the sensor data communication session. Tests using a single sender showed that even at a packet rate of 10 packets/second, packets were received reliably. Thus, the system is scalable to at least 50 sensor nodes 104/204 where each sensor sends data once every 5 seconds.

At connection time, the GUI server 218 and the bridge software exchange a preamble with the following two ASCII bytes: 85, 32. This confirms that both ends of the communication channel follow the default TinyOS™ packet protocol. Every data packet from the sensor network 202/206 to central command after the two connection bytes may have the following format:

| Field | #bytes | Java type | Description |
|---|---|---|---|
| Length | 1 | byte | Number of following bytes in the packet. This should be 42. |
| NodeID | 4 | int | Unique identifier of a PATS sensor node/firefighter. The lowest 8 bits indicate the firefighter number within a squad (valid values: 0-254). The next higher 8 bits indicate the squad number (valid values: 0-255). |
| Timestamp | 4 | int | Unique identifier of a message from a node (valid values: 0-65535). Note that messages can arrive out of order, i.e., Timestamp of successive messages from a node may not increase. |
| SensorType | 1 | byte | Indicates how to interpret the SensorValue field. Currently, SensorType = 1 to indicate SensorValue is a temperature reading. |
| SensorValue | 8 | double | Sensor measurement. When SensorType = 1, SensorValue is in degrees Celsius. (The PATS temperature sensor has a resolution of 0.0625° C.) |
| GPSstatus | 1 | byte | Indicates if valid GPS data is available in GPSLatitude, GPSLongitude, GPS time fields. GPSstatus >=10 indicates GPS fields contain valid data.<br>GPSstatus = 0: GPS fields are invalid; no GPS packet received<br>GPSstatus = 1: GPS fields are invalid; no GPS fix<br>GPSstatus = 2: GPS fields are invalid; unrecognized GPS packet<br>GPSstatus = 10: GPS fields are valid; GGA packet received<br>GPSstatus = 11: GPS fields are valid; RMC packet received<br>GPSstatus = 12: GPS fields are valid; GLL packet received |

-continued

| Field | #bytes | Java type | Description |
|---|---|---|---|
| GPSLatitude | 8 | double | Latitude in decimal degrees. Valid range is −90.0 to +90.0. Example value: 34.2014 |
| GPSLongitude | 8 | double | Longitude in decimal degrees. Valid range is −179.99 to +180.0. Example value: −119.674017 |
| GPStime_hour | 1 | byte | Integers between 0 and 23 (UTC time) |
| GPStime_minute | 1 | byte | Integers between 0 and 59 (UTC time) |
| GPStime_second | 1 | byte | Integers between 0 and 59 (UTC time) |
| GPStime_year | 2 | short | Integer representing 4 digit year (UTC time) |
| GPStime_month | 1 | byte | 0 to 11 |
| GPStime_day | 1 | byte | 1 to 31 |
| AlertStatus | 1 | byte | $A_7 A_6 A_5 A_4 A_3 A_2 A_1 A_0$<br>$A_0 = 1$: firefighter has pressed Alert button<br>$A_4 = 1$: firefighter is Inactive (from acceleremoter)<br>$A_5 = 1$: firefighter is in Freefall (from acceleremoter)<br>Bits 1-3, 6, 7 are not used. |

The bridge software also accepts text messages from the SAP server 212 over the same TCP connection used to send sensor data from the nodes 104/204 to the command center. Specifically, the data type that is to be distributed is represented as a string of ASCII characters along with a destination node address. Every data packet from central command to the sensor network 202/206 after the two connection bytes may be of the format:

| Field | #bytes | Java type | Description |
|---|---|---|---|
| PacketLength | 1 | byte | Number of bytes to follow (valid values will be 7 to 26) |
| DestinationNodeID | 4 | int | Unique identifier of a PATS sensor node/firefighter.<br>The lowest 8 bits indicate the firefighter number within a squad (0-254). A value of 255 indicates a broadcast message to all firefighters.<br>The next higher 8 bits indicate the squad number (valid values: 0-255). |
| MessageType | 1 | byte | Set to 0. |
| MessageString Length | 1 | byte | Number of bytes in MessageString. Valid values: 1-20. |
| MessageString | 1-20 | byte[ ] | A sequence of ASCII characters in the range 32-126. |

Web Browser-Based GUI

Visualization of sensor data from PATS nodes 104/204 and communication of text messages and alert commands to individual PATS nodes 104/204 is made using the SAP Internet-based system. Every SAP system has a single server 212, that functions as a central repository of SAP operational information.

Any number of clusters of PATS nodes 102/204, each one managed by a single PATS "base station" device 114/208, may connect to a single SAP server 212. Within the server 212, a separate base station thread is spawned to handle acquisition of data from each base station 114/208. Likewise, any number of SAP users (web clients) may connect concurrently to a single SAP user. Each such connection is termed a "session". Any single session may be in either real-time mode or in replay mode at any time. Both the SAP server 212 and an SQL server (e.g., a MySQL™ server) may execute within cloud machines (e.g., Amazon™ cloud machines).

Two-Way Communication of Alerts

The embedded PATS node software and the SAP GUI communicate and display alerts between the command center and individual sensor nodes 104/204. These specific modes of communicating alerts may be implemented:

1. Pressing the Alert/alarm switch on a PATS sensor node 104/204 transmits an alert signal using multi-hop routing to the base station node 114/208, transferred over the Internet 216 from the base station 114/208 to the GUI server 212 and displayed on the browser-based GUI 218 using a special Alert icon.
2. A text message and destination ID entered into the GUI 218 is forwarded to the base station 114/208; the base station 114/208 then broadcasts the message to all nodes 104/204 using multi-hop routing. Only the intended destination node 104/204 acts on the message by displaying it on an OLED display, turning on the Alert LED and producing beeps on the speaker.
3. A special text message, "WARNING", causes the Alert LED to flash and the speaker to beep at 2 second intervals.
4. A special text message, "DANGER", causes the Alert LED to flash and the speaker to beep at 0.5 second intervals.

A special text message, "CLEAR", causes the Alert LED to stop flashing and the speaker to stop beeping. Receipt of this message is acknowledged by the removal of the alert icon from the command center GUI. Thus, multi-modal user interaction consists of an alarm switch based on application needs, and an integrated graphic display to alert a first responder group of an emergency situation.

Further, a special address of "255" may indicate a message is to be sent to all nodes.

Hardware Design

As described above, current radios used by firefighters provide for voice communications but do not support the capability for data handling to monitor the movements and status of firefighters and provide alerts to them while in the field fighting fires. To implement such a communication infrastructure for remote environments required development of a compact, wireless sensor node for tracking firefighters' position and status while operating in wild land fire environments with minimal intervention by the fire fighters. This functionality was achieved with the development of a small handheld node with an onboard radio and sensors to monitor temperature, acceleration and GPS position. In addition to the sensors, the node also includes a speaker, Light Emitting Diode (LED) and Organic LED (OLED) display to provide both audible and visual alerts from the incident command center back to the firefighters in the field.

A PATS sensor node 104/204 is designed to collect information from a variety of sensors, perform signal processing of the sensor measurements, transmit sensor data over the network, and receive messages from the network to be displayed to its user. The sensor node 104/204 is intended to be carried by a person and so its location can vary in the sensor network.

Figure 6:
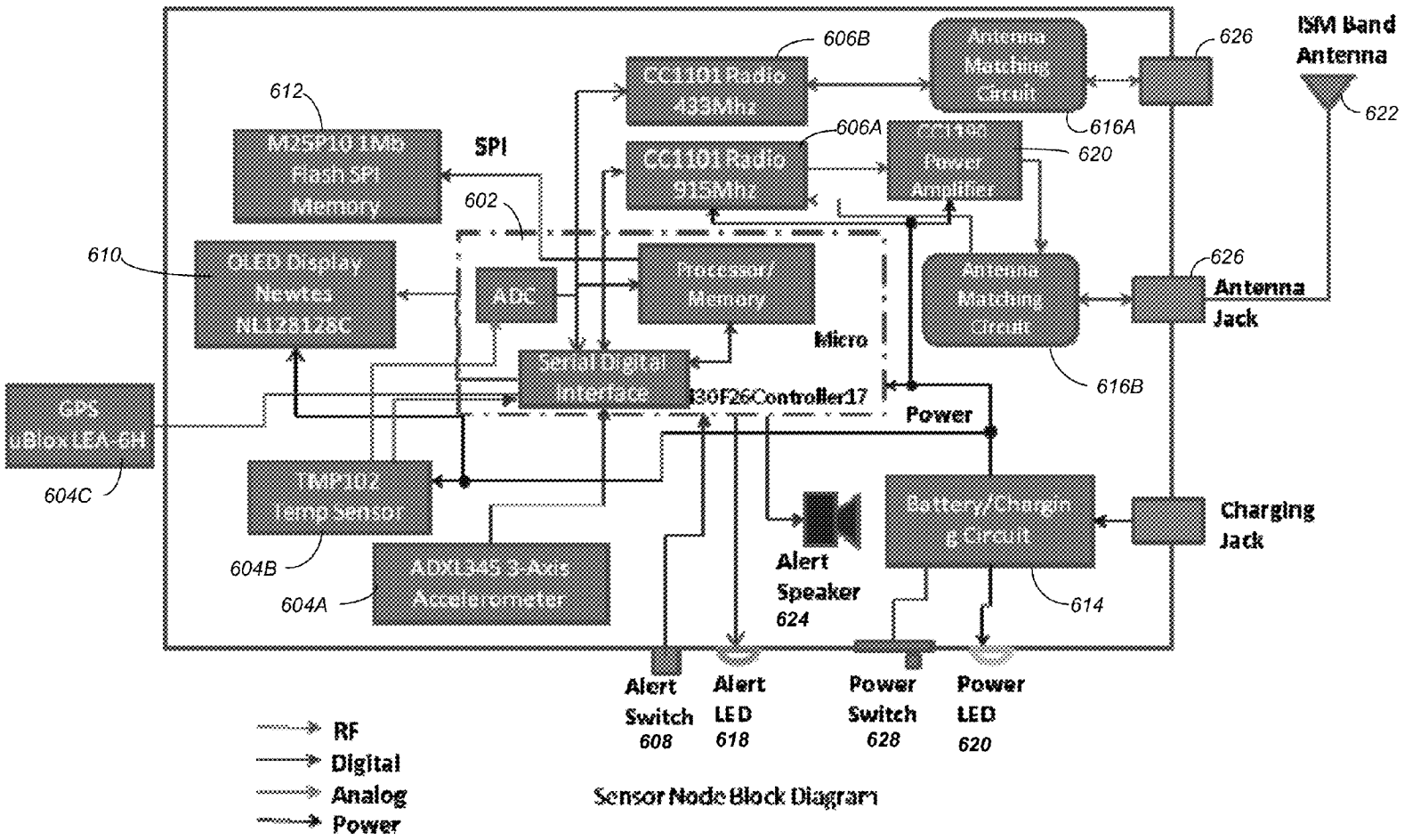
FIG. 6 illustrates a block diagram of a PATS sensor node in accordance with one or more embodiments of the invention.

FIG. 6 illustrates a block diagram of a PATS sensor node 104/204 in accordance with one or more embodiments of the invention. The PATS hardware design currently includes an ultra low power micro controller 602, sensors 604, and two radio transceivers 606A and 606B.

The microcontroller 602 (also referred to as a microcontroller unit—MCU) may be from Texas Instrument™'s low power 16-bit MSP430 family of microcontrollers (e.g., TI MSP430Fs617 with 92 KB of Flash memory, 8 KB of SRAM, four serial ports [configurable as two SPI/I2C ports and two UART ports], 8 Analog-to-Digital Converter [ADC] channels and numerous digital input/output [I/O] ports). Such a microcontroller 602 may use a 3V power source with up to 16 MHz clock rates, consume ~10 mA of current at the highest clock rate, and is available in a 113-pin Ball Grid Array (BGA) package that is 7.1 mm on a side. The small size, power and available digital and analog inputs/outputs make this MCU 602 a good fit to the PATS node design. The microcontroller 602 has four digital ports for interfacing digital sensors 604 and the radio transceivers 606. The hardware architecture is designed to be upgradeable as the digital and analog ports of the microcontroller 602 allow for additional sensors in the future.

As illustrated in FIG. 6, the TI MS430F2617 low power micro controller 602 is used for the overall controller of the node to operate the radio(s) 606, read telemetry from the onboard temperature 604B and accelerometer 604A sensors and the off-board GPS module 604C and also implement the Collection Tree Protocol (CTP) used to perform the ad hoc routing of the local mesh network.

Further, the block diagram of FIG. 6 includes the part numbers for the major components including the MCU 602, radios 606, sensors 604, memory 612 and OLED display 610. This functionality of the node board includes onboard processing, dual radios 606 (433 MHz and 915 MHz bands) with corresponding antenna matching circuits 616, battery charging circuitry 614, SPI-based external memory 612 for the MCU 602, accelerometer 604A, temperature sensor 604B, serial port for a UART-based GPS interface 604C and text capable display 610. Thus, the MCU node board includes the TI MSP430F6217 MCU 602, a 1-Mbit flash memory (M25P10-A) 612, 3-axis accelerometer (ADXL345) 604A, temperature sensor (TMP102) 604B, 128×128 OLED display (NL128128C) 610, momentary tactile switch 608 for alerts and light emitting diodes (LEDs) 618 and 620 for various indicators. The tactile switch 608 enables a firefighter to communicate an alert condition to the command center in the case of an emergency.

The sensors 604 are a 3-axis accelerometer 604A, temperature sensor 604B, and GPS module 604C. The onboard accelerometer chip 604A is capable of generating interrupts when it detects a free-fall or extended period of inactivity. This capability is used to automatically generate and transmit an alert condition via the sensor web in case the user suffers a fall or is immobilized due to an accident. The user can also generate an alert condition by pressing a dedicated switch 608.

The two radio transceivers 606A and 606B are configured to operate in the 902-928 MHz (606A) and 415 MHz (606B) range. The 900 MHz radio 606A is used for mesh networking at the Tier 1 layer while the 415 MHz radio 606B is to be used for a long-distance relay link. A 1" square, 128×128 pixel, color display 610 is provided so that text messages can be displayed to the user. The node also contains a flash memory chip 612 to store up to an hour of sensor data. Thus, when there is no radio connectivity, the internal memory may store the sensor data and relay the data when connectivity is reestablished (e.g., thereby providing disruption tolerant networking) The internal memory may utilize a FIFO (first in first out) buffer to store the packets during an RF link outage. The PATS node is powered using 2 AA batteries. For the node design to support the 2-tier PATS network architecture, the node design may also incorporate an externally accessible UART for use with a Commercial-Off-The-Shelf (COTS) 433 MHz band radio to implement a long-range relay link.

Most node components, including the microcontroller 602, radios 606, and sensors 604 are integrated into a single circuit board. In other words, such a board may have two onboard radios 606A and 606B, one for the PATS 915 MHz ISM band local mesh network and one for the 433 MHz band radio as a backup option to provide the relay link function.

A separate daughter board may house the OLED display 610, alert switch 608, display/alert LED 618, and mating extension headers for the ports. Connectors on this board may also provide for USB communication via a Serial-to-USB cable. All of these components may be supported by the TinyOS™ embedded operating system. A JTAG (joint test action group) adapter may be available for flash programming the microcontroller 602 with embedded software.

Thus, in view of the above, a PATS node hardware radio/sensor design may include the following components:

- MSP430F6217 micro controller (MCU) 602
- 900 MHz radio for tier 1 layer 606A
- 400 MHz radio for tier 2 606B
- 3-axis accelerometer detects free-fall and inactivity events 604A
- Temperature sensor at 0.5° C. accuracy and −25° C. to +85° C. range 604B
- Power circuitry for operation using 2 AA batteries 614
- GPS module provides 2 m accuracy in latitude/longitude 604C
- Flash memory to store up to an hour of sensor data 612
- Serial ports for additional radio/sensors
- ABS plastic case rated at 100° C.
- OLED display 610 protected with Lexan plastic
- 2×SMA antenna connectors 616A and 616B
- Alert 618 and Power on 620 LEDs
- Alert push-button switch 608

Free-fall and inactivity detection may be provided. The onboard accelerometer (ADXL345 chip) 604A generates interrupts when it detects a free-fall and/or extended period of inactivity:

- Free-fall event
  - All three axes of the accelerometer 604A detect acceleration below a threshold for a period of time;
- Inactivity event
  - All three axes of the accelerometer 604A experience a change in acceleration of less than a threshold for more than a pre-defined time.

Parameters can be easily changed according to firefighter situational parameters.

The dual radios 606 in the node may both be Chipcon™ CC1101 from TI™ with the 915 MHz radio 6906A including the CC1190 combination unit 620 which includes a Power Amplifier (PA) and Low Noise Amplifier (LNA). The matching networks 616 provide maximum power transfer between the radio 606 and antenna 622 for the 433 MHz band and the PA/LNA 620 and antenna 622 for the 915 MHz band. Both radios use 50 ohm antennas 622. The node power circuitry 614 uses a DC-DC converter to provide a stable 3.5V rail for regulators used to drive the radios 606, sensors 604A and 604B and GPS module 604C even as the battery voltage drops over time due to usage. A battery charging circuit may also be integrated into the node power circuitry 614 should there be utility in using rechargeable cells for the node power pack. The charging circuitry may also be able to power the node directly. A 3.3V RS232 port may also be utilized in the design to power and provide communication between the MCU 602 and plug in GPS module 604C. The node board also includes analog/digital interfaces for additional off-board sensors/radios, LED indicators 618/620 for the displaying the state of the battery if using the charging circuit 614, a piezo speaker 624 for an audible alarm, IO ports for general purpose digital/analog connections and serial ports including SPI, $I^2C$ and 3.3V RS232 interfaces.

A search of commercially available GPS chips and modules identified the ublox C04-6H GPS smart antenna LEA-6H Reference design as a good candidate for the GPS module. This component provides positional accuracy in the 2 to 5 m range, requires a single +5V input voltage with 3V UART connectivity and is well suited for interconnection with the MSP430F2617 MCU on the PATS node board.

Figure 7:
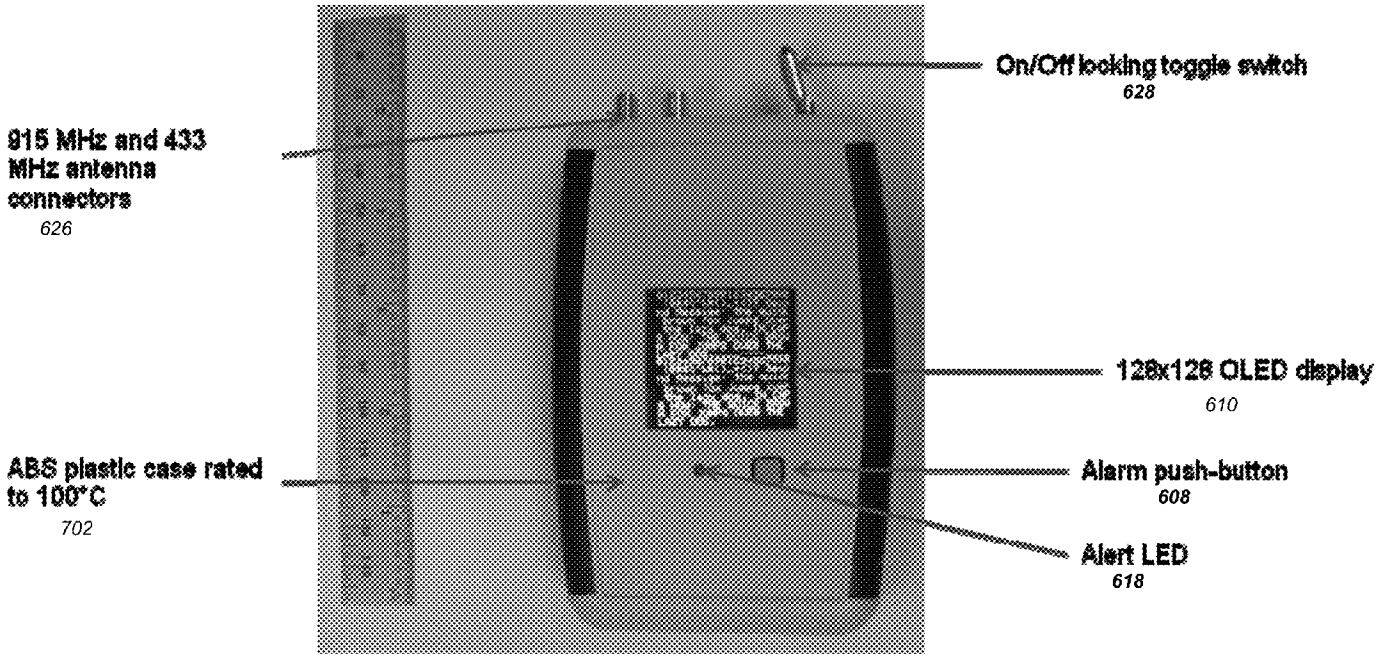
FIG. 7 illustrates external features of the PATS node in accordance with one or more embodiments of the invention.
Figure 8:
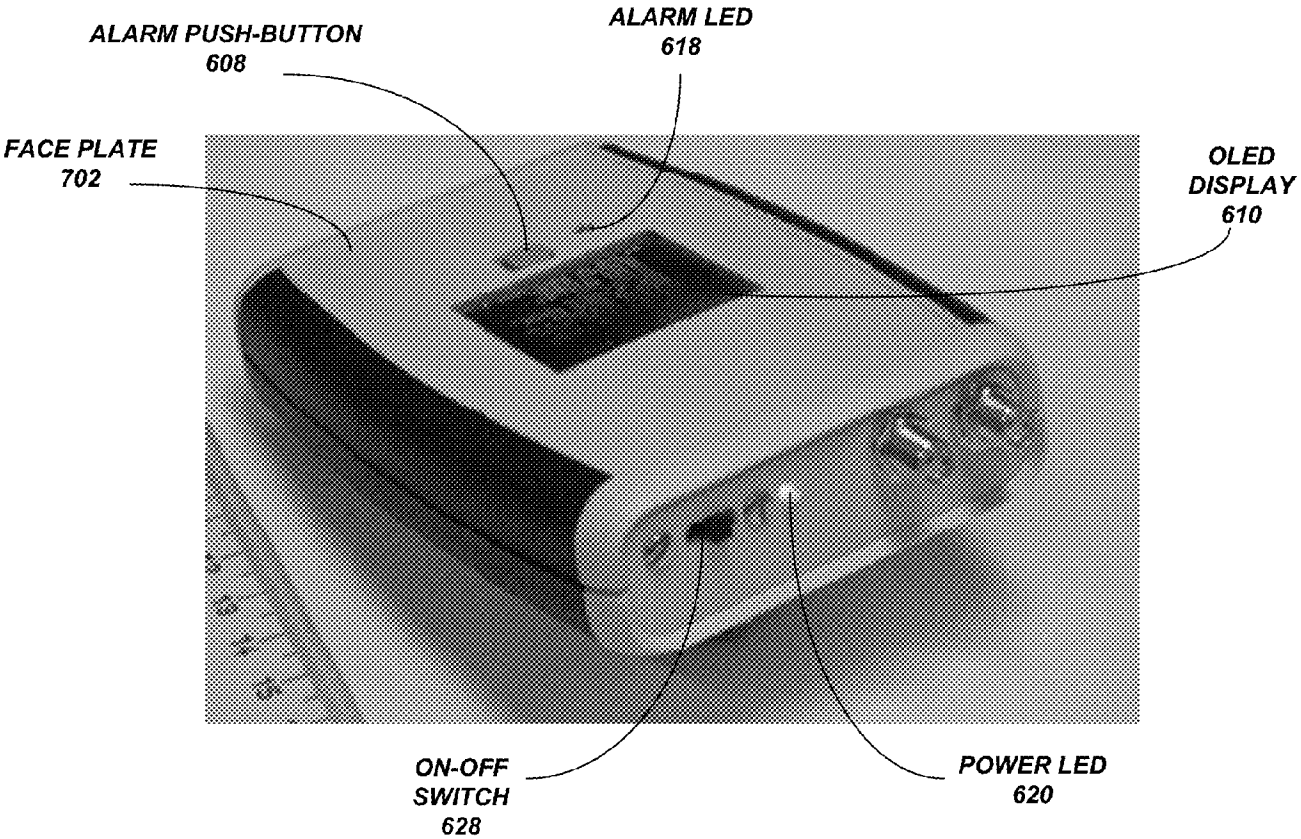
FIG. 8 illustrates the sensor chassis layout in accordance with one more embodiments of the invention.

The physical layout of the sensor node is shown in FIGS. 7, and 8. FIG. 7 illustrates external features of the PATS node in accordance with one or more embodiments of the invention. FIG. 8 illustrates the sensor chassis layout in accordance with one more embodiments of the invention. In these figures, the OLED Display 610, alert LED 618, and alert switch 608 are on the top face of the node. The face plate 702 of the node chassis has the SMA connectors 626 for the 433 and 915 MHz radios. For the sensor node, only the 915 MHz radio 606A is active. The slider power switch 628 is also placed on the chassis faceplate 702 along with a green power LED 620.

Antenna Design

In testing radio modules and PATS designed components, it was found that the power transfer to commercially available antennas from the radios were very susceptible to external factors due to being monopole antennas. The primary reason for this issue is that a monopole antenna does not have a ground structure to establish the RF field pattern. To remedy this situation, embodiments of the invention utilize custom sleeve dipole antennas to define the RF field patterns with minimal impact by the external environment. Such a sleeve dipole transfers almost 100% of the power whether a ground plane is used or not with the antenna. A summary of these findings is presented in the following list:

- Impedance match between the radio output and PA input was satisfactory but the match between the PA output and antenna was not.
- Stock antennas do not have a ground plane and their impedance is highly susceptible to objects near the antenna. When plugging the antenna into the PA, the impedance mismatch results in >8 dB of loss.
- Built custom sleeve dipole antennas for 433 MHz and 915 MHz operation
- Custom antennas provide proper impedance match between the output of the PA and the antenna for maximum power transfer.
- Procured ZX60-V82+PAs from Mini Circuits to provide up to +19 dBm (~100 mW) of output power at either 433 MHz or 915 MHz (which is 10× the CC1101 radio maximum output power) for improved range
- Achieved up to 2 km range by enclosing node in metal box for proper grounding and using sleeve dipole at base station In contrast to the sleeve dipole antennas, the performance of the standard whip antenna was also characterized when installing the antenna on a bulkhead connector mounted to a metal prototype node enclosure. In such a configuration, the enclosure becomes the ground plane of the antenna and results in ~1 dB of loss when connected to the PA and −2 dB of loss when connected to the radio directly (as compared to >8 dB loss without the enclosure).

PATS Embedded Software

The PATS embedded code for both the sensor and base station nodes may operate in Linux and/or TinyOS™. TinyOS™ includes a cross-compiler used to build executable files with the proper instructions for a specific target processor (e.g., MSP430F2617 in this case). TinyOS™ additionally defines the packet format for the sensor and base station nodes and provides translation of the low-level packet format in TinyOS™ to the higher-level fields used by Java™ (which may be used for the PATS bridge code). Java SDK™ is the software development kit used to generate this conversion.

TinyOS™ as a cross-compiler needs to define the target part, the pin I/O definitions and list of functions to use for compilation when making the executable file. The "make" command for the sensor node compilation has the form, "make pats1 install.<node_ID>", where node_ID is the node number associated with the executable file being built. The pats1 file is a batch file that includes i) the target part number (PN), ii) the path for the list of code modules, iii) the top-level component (i.e. top-level code to be compiled), and iv) the path for the list of I/O specification files. This file is the TinyOS™ platform file (*.platform) and consists of these four elements.

Figure 9:
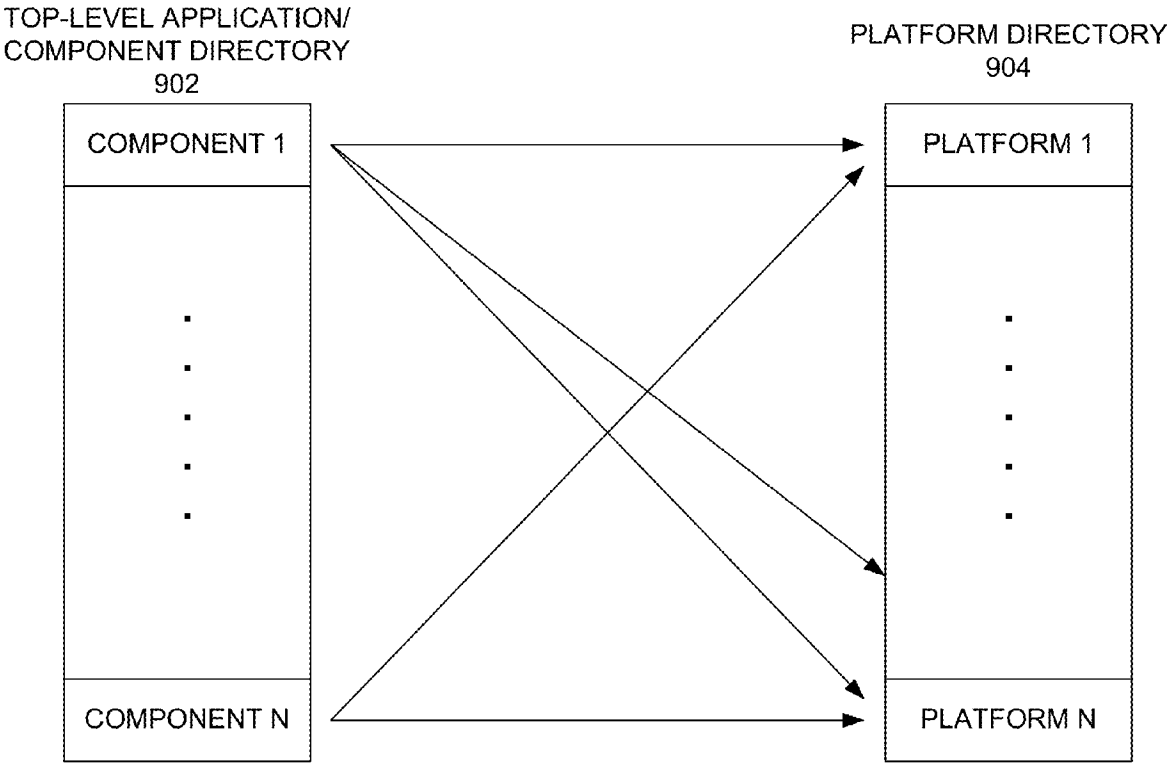
FIG. 9 illustrates a TinyOS™ mapping between a top-level application (i.e. component) and a low-level configuration (i.e. platform) in accordance with one or more embodiments of the invention.

In TinyOS™, the component or top-level application specifies the top-level code, which is the definition of what is in the application. For PATS, there are three component types—sensor node, base station 915 MHz, and base station 433 MHz. The platform file specifies the particular target part configuration (e.g. PATS sensor node, PATS 900 MHz base station node, etc.). So a given top-level application can be mapped to multiple target devices by using the appropriate platform file. In essence there are two directories used to build a particular executable including: i) the top-level application directory with the source code and "make" file for each application; and ii) the platform directory with the platform files to map a particular applications to a particular device. This mapping assumes that a particular component/top-level application can be supported by a given platform. This directory mapping is shown FIG. 9. In other words, FIG. 9 illustrates a TinyOS™ mapping between a top-level application (i.e. component) 902 and a low-level configuration (i.e. platform) 904. This architecture allows for mapping an application into multiple different physical devices (provided they are compatible) to make the application portable.

Given the above architecture, TinyOS™ files are composed of a file pair including the source code and link files, where the link file provides the file name to the underlying module definition. This convention is followed for the platform file specification to provide path information. All TinyOS™ source files may be in nesC™ files and have the extension *.nc. nesC is a language that is an extension of C to support event-driven programming. During cross-compilation, the nesC code is translated to C, then compiled using gcc for the particular microcontroller. nesC code for TinyOS™ may consist of modules (which implements a specific function such as reading from the ADC), configurations (which integrates multiple modules into one component), and interfaces (which define which functions of a component are callable by other components). In the top-level application file, the line with "Main C" has the name of the top-level application and the line with "Boot.booted" is the entry point into the top-level code after boot up is complete.

For the PATS implementation, the same node board may be used to implement both the PATS sensor node and PATS base station node. Consequently the same platform file is used for either PATS node type but the component file (i.e. top level application code) is different to delineate the functional difference between the node types using the same physical platform. As a result, the embedded node code is embodied in two components (sensor and base station nodes) and one platform for the PATS node board. Incidentally, two additional components and one addition platform type may be used in alternative versions of the node boards to implement master and slave 433 MHz base station nodes for testing of the onboard 433 MHz radio.

In view of the above, identical hardware may be used as a firefighter-held sensor node, relay node, and basestation node. Hence, different TinyOS™ applications are provided which enables the same hardware to perform these different roles. The four top-level applications used in PATS are:

CTP_Diss_Tmp_GPS_Accel: This is the application that runs on PATS sensor nodes. Compile time parameters can set the radio rate, amplifier gain, etc. Executables for different sensor nodes are created by providing distinct node ids during compilation.

BaseStationPATS: This is the application that runs on the 915 MHz PATS base station node. Compile time parameters can set the radio rate, amplifier gain, etc.

BaseStation433 MHz: This is the application that runs on the 433 MHz PATS relay node connected to the 915 MHz PATS base station node (with a UART crossover cable). This may make use of a modified version of the TinyOS™ serial stack.

BaseStation433 MHz_PC: This is the application that runs on the 433 MHz PATS relay node connected to the bridge PC (with a USB cable). This makes use of the standard TinyOS serial stack.

nesC application code is cross-compiled for a specific "platform" 904. A platform specification defines the microcontroller and the peripheral driver libraries that can be used to compile applications for an embedded node. There are two "platforms" 904 defined for the PATS hardware. These are called "pats1" and "pats1_433mhz". Such platforms can be directly used as a target for compiling (TinyOS™) applications for the PATS nodes. Applications CTP_Diss_Tmp_GPS_Accel and BaseStationPATS run on the pats1 platform. Applications CTP BaseStations433 MHz and BaseStation433 MHz_PC run on the pats1_433mhz platform.

The microcontroller 602 on the PATS node may be programmed using its JTAG interface. Further, a USB-based Flash programmer (e.g., TI's MSP-FET430UIF) may be used for this step. The machine code may be generated using a compiler tool chain provided as part of the TinyOS™ development environment.

The 915 MHz radio 606A and power amplifier 620 may be controlled using a radio driver (e.g., the Blaze™ radio driver distributed with TinyOS™-contrib library). All radio communication parameters may be set by the embedded software at compile time including carrier frequency, bit rate, Rx filter bandwidth, modulation type, and Tx power.

The radio 606A in the PATS node (CC1101) is interfaced with an RF front end chip (CC1190), which includes a power amplifier (PA), a low noise amplifier (LNA) and a transmit/receive switch. In order to control the RF paths to the PA/LNA for transmit/receive functionality, control signals for the RF switch and enable lines for the PA and LNA are provided in the hardware design via GPIO (general purpose input/output) lines. In addition, the CC1190 amplifier 620 has a gain control input line (to select between low and high gain modes). These RF switch controls and the gain control are generated from within the CC1101 radio driver code The CC1101 driver code may need to be modified to directly control the Rx/Tx switch control lines during the two-way communication. This is required since during multi-hop communication, a sender listens for an acknowledgement message after every transmission.

In the 433 Mhz radio 606B, the CC1101 radio with a 433 MHz matching network is interfaced to the microcontroller 602 using the SPI bus. This radio chip may be controlled using a standard Blaze™ driver since it does not have a power amplifier/LNA at its output (with associated RF switches).

The OLED Display 610 (e.g., a NL128128C-EIF display) is used to display information in PATS. Exemplary embodiments of the OLED display 610 may be a 1" square 128×128 pixel 18-bit color display using the OLED technology (i.e., a backlight does not have to be used as in conventional TFT-LCD displays).

A TinyOS™ driver may be required to integrate the color graphic display with the handheld PATS sensor node. A driver may send commands to the driver controller chip using the SPI interface. Further, the driver may specify 16-bit color for each pixel Further, the driver may be configured to use all of the 128×128 pixels.

The PATS display driver (in one or more embodiments) supports the display of 5×8 pixel ASCII characters.

An exemplary onboard accelerometer 604A for the PATS device may be the ADXL345 chip. This accelerometer 604A is capable of generating interrupts when it detects a free-fall and/or extended period of inactivity. This feature is used in the PATS nodes so that the X, Y, Z axis accelerometer measurements will not need to be continually transmitted. Instead, only the sensor measurements that meet the detection criteria is sent in the radio packet (Alert byte). The free-fall event is defined when all three axes of the accelerometer detect acceleration below a pre-defined acceleration level for a period of time (that is also pre-defined). An inactivity event is defined if the all three axes of the accelerometer experience a change in acceleration of less than a pre-defined value for more than a pre-defined time. Code may be used to set the acceleration levels and time period thresholds in the accelerometer 604A, and also to detect the interrupts when they are fired. These parameters can be easily changed according to the preferences of the firefighters.

There are two UART ports from the microcontroller 602 that are made available via headers on the PATS node. One of the ports has been programmed to interface with the GPS board 604C while the other UART port provides a bi-directional data communication link to a PC via a USB-Serial adapter cable.

The temperature sensor 604B is interfaced to the microcontroller 602 over a I2C bus. TinyOS™ drivers may be used to control this sensor.

The flash memory chip 612 may be interfaced to the microcontroller 602 using the SPI bus. This chip 612 was tested to be functioning correctly but may not be integrated into the application code.

There are three LEDs (including alert LED 618 and Power LED 620) that are mounted on the main board that can be controlled by the microcontroller 602. The bright Alert LED 618 that is attached to the daughter board is also controlled by the embedded code.

Bridge Code/Software

The PATS bridge code is a PC-based application. The application may run under a variety of operating systems and be programmed in a variety of programming languages (including Java™). This application is used to communicate with the PATS base station node 114/208 connected to the PC 214 to collect telemetry from the PATS mesh network and to send commands back into the PATS network from the command console 116. It also connects to a TCP/IP socket as the mechanism to send the PATS telemetry to the remote SAP server 212 and to receive commands from the server 212 to relay them back to the PATS base station 114/208 for dissemination to the appropriate PATS sensor node(s) 104/204.

The steps to activate the bridge software on the Bridge PC 214 are as follows. This assumes that the PC 214 has access to the Internet 216 and that the SAP server 212 is running (e.g., on a port that the PC 214 can communicate through).

1. Connect the PATS base station node 114/208 to the USB port. This should create a virtual COM port visible in the Device Manager.
2. The SAP server's (IP) address should be provided on the command line along with the virtual COM port connected to the PATS base station node 114/208.

To simplify these steps, shortcuts can be created where these command line parameters are already specified. Then, simply clicking the shortcut will start the PATS bridge program.

Situational Awareness and Prediction (SAP) Graphical User Interface

The SAP user interface is the software that collects PATS sensor 104/204 measurements over a TCP channel, inserts it into a database, and presents the data overlaid over a map interface at the command center 116. The GUI interface system is a two-layer system that can also be used to relay messages from the command center 116 to the PATS sensor network 102. The user interface may be displayed on a variety of hardware devices 218 as described in further detail below.

SAP server code may be written in the Java™ programming language and may execute within a Jetty™ web server. Whenever a session enters replay mode, two threads are spawned:

A "replay" thread offers a server socket at which it acquires the requested replay activity information, simulating the operation of a base station thread. The thread records the acquired information in a list of the most recent replay updates for the nodes whose activity is being replayed. This information is returned to the client whenever the client (in replay mode) "polls" the server for node state information.

A "replay driver" thread retrieves the requested replay activity information from the SAP database, connects to the replay thread, and transmits the retrieved update records to the replay thread at the requested rate, simulating the operation of a PATS base station.

The SAP GUI design accepts and transmits PATS sensor node packets, including relaying the position of individual firefighters with associated sensor information to a centralized command display and the ability to send warning messages back to the firefighters for alerts. The integration of a SAP interface with the PATS sensor network 10 includes: (i) presentation/suppression of the PATS node sensor labels via a settings dialogue button; (ii) inclusion of tabs to toggle between displays for the PATS nodes, white boarding capability and incident history; (iii) generate/send broadcast messages to all PATS nodes; (iv) maintain latest GPS latitude/longitude when new GPS data is not available; and (v) maintain elapsed time when pausing data playback to resume with the proper time index.

General database cleanup was also performed to support the new capabilities that were added to SAP. These involved updating all PATS records that contained an invalid GPS status along with removing records that contained a node number zero. Using remote processing capability (e.g., Amazon™ cloud machines) for both the SAP server and the MySQL™ database server made these kinds of adjustments very easy to accommodate.

In making these modifications, the SAP architecture caused actions made by any user of the SAP browser interface to affect the actions on the interfaces of all other simultaneous SAP users. In particular, this could prevent a user from seeing real-time sensor data if another user had activated the replay mode on another browser. The architecture of the SAP interface isolates the actions of different users. Accordingly, properties associated with the GUI include:

- Replays are per-client, so multiple different replays (at different speeds, etc.) can be viewed by different users while everybody else is watching the real-time stream.
- The alarm temperature that's used for triggering UICDS (unified incident command and decision support) alerts is hard-coded in the server, as it needs to be known and stable in order for the UICDS alerts to be meaningful to UICDS users. Each SAP user can adjust warning temperature and alarm temperature on the local client display individually, to highlight areas of some temperature range of interest.
- UICDS alert conditions are detected at the server and immediately posted to UICDS; UICDS alert messages returned from UICDS are queued up individually to be polled by SAP clients, so each client sees all the messages.
- A "Reset" button is in a global "Control messages" control panel. Since hitting "Reset" wipes out current real-time state for all nodes of the system, the location of the button avoids hitting "Reset" by mistake when trying to press "Clear".
- The SAP server tracks PATS bridges individually, so a control message sent to "all nodes" will be conveyed to all nodes reachable through all bridges, not just the ones that are reachable through the most recently active bridge.

The result of the above enables the SAP GUI to display data via a browser window that accesses the server via port 8080. The browser can be located on the same PC with the server or can be run on a remote machine and accesses the server via the Internet. Multiple browsers can access the server data simultaneously from various locations.

Figure 10A:
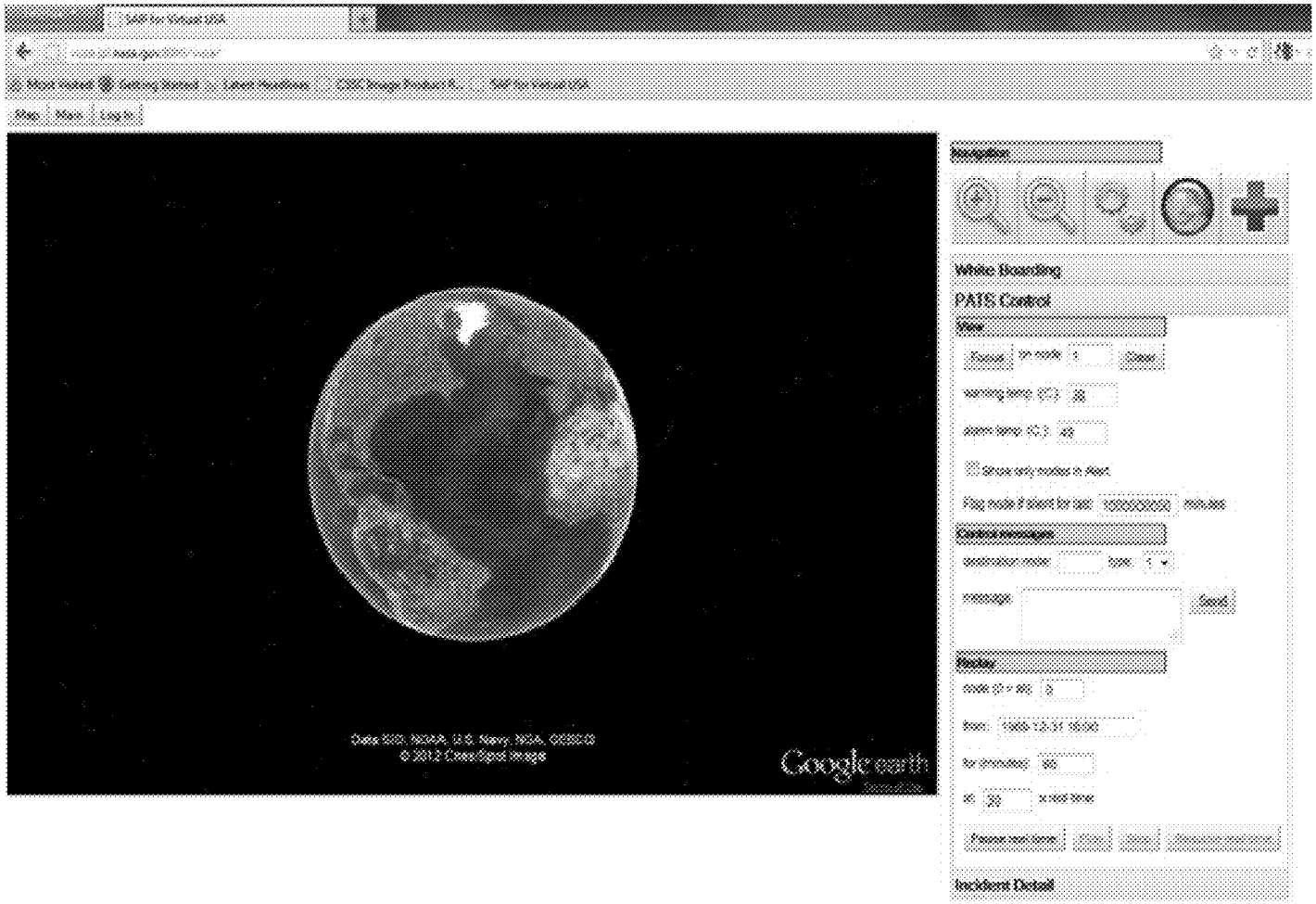
FIGS. 10A-10B show the SAP GUI (Situational Awareness and Prediction Graphical User Interface) graphical display showing the "Earth-view" and localized locations of nodes in the theater of operation, alert status of nodes and pop-up display with detailed telemetry in accordance with one or more embodiments of the invention.
Figure 10B:
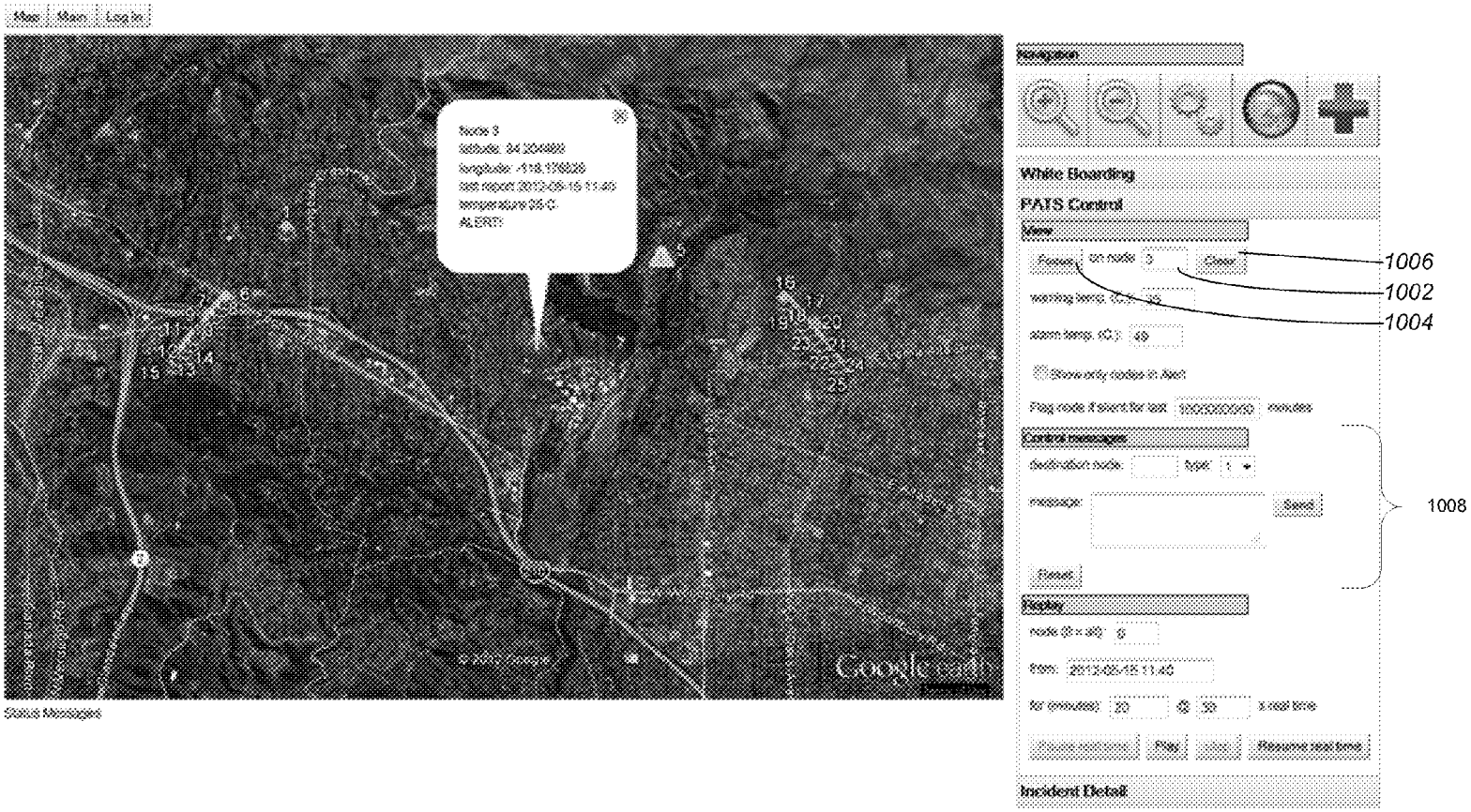

An example of the SAP graphical display is shown in FIGS. 10A-10B. More specifically, FIGS. 10A-10B show the SAP GUI graphical display showing the "Earth-view" and localized locations of nodes in the theater of operation, alert status of nodes and pop-up display with detailed telemetry. FIG. 10A shows the display when the browser window is first opened. FIG. 10B shows a localized map of the sensor node(s) location with the map displayed on the left side. This "zoom in" function is accomplished by entering the desired node number in the text box 1002 at the left of the "Focus" button 1004 at the top right of the display and then clicking the Focus button 1004 to zoom into the location for a particular node. Additional user controls are shown at the right of the display and can be used to set or clear 1006 alerts and send text messages 1008 to individual sensor nodes or broadcast the messages to all nodes in the PATS mesh.

Visualization/Computer Hardware

Figure 11:
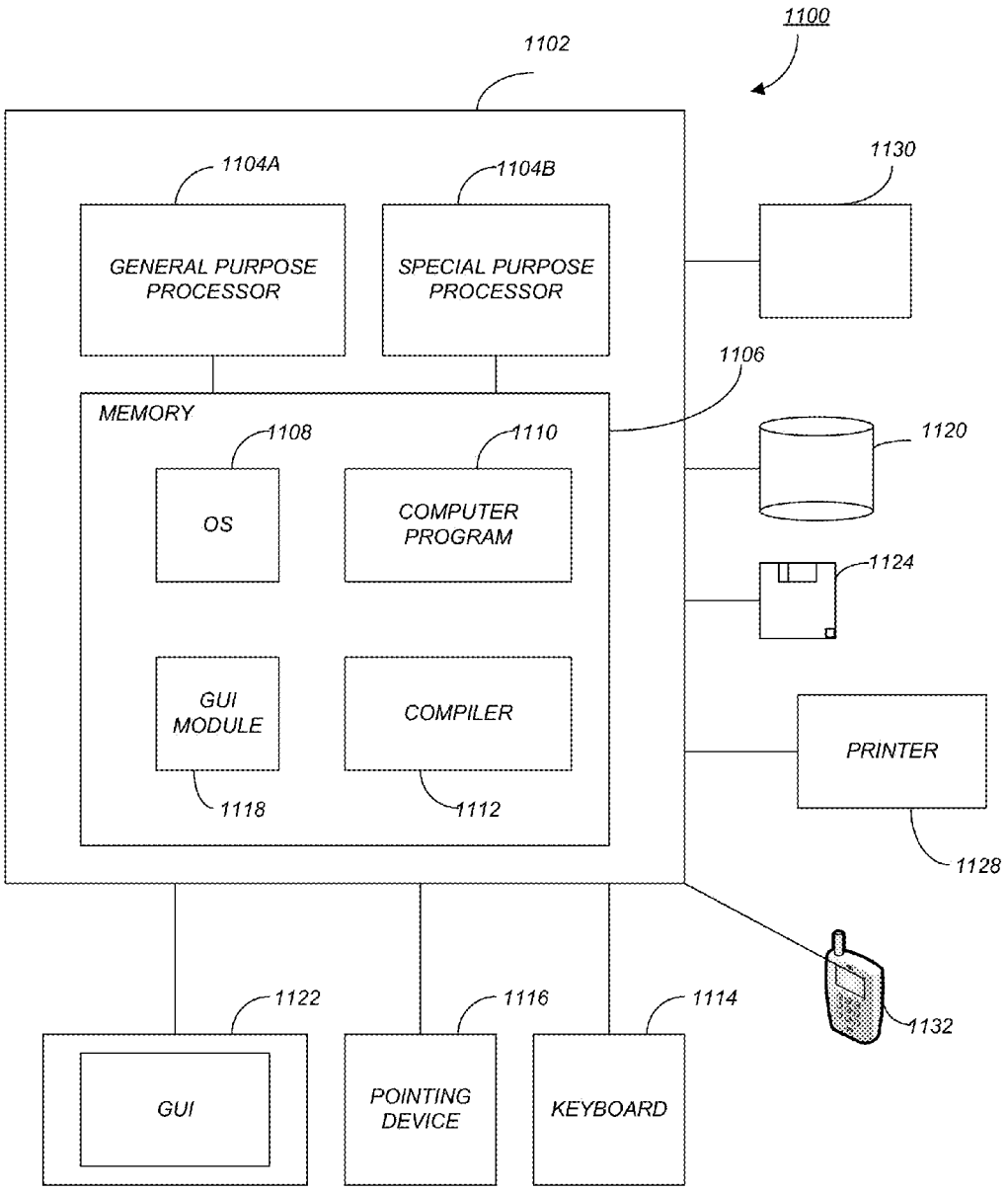
FIG. 11 is an exemplary hardware and software environment used to implement one or more embodiments of the invention.

FIG. 11 is an exemplary hardware and software environment 1100 used to implement one or more embodiments of the invention (e.g., the Bridge 214, server 212, SAP visualization 218, and or other components of the system). The hardware and software environment includes a computer 1102 and may include peripherals. Computer 1102 may be a user/client computer, server computer, or may be a database computer. The computer 1102 comprises a general purpose hardware processor 1104A and/or a special purpose hardware processor 1104B (hereinafter alternatively collectively referred to as processor 1104) and a memory 1106, such as random access memory (RAM). The computer 1102 may be coupled to, and/or integrated with, other devices, including input/output (I/O) devices such as a keyboard 1114, a cursor control device 1116 (e.g., a mouse, a pointing device, pen and tablet, touch screen, multi-touch device, etc.) and a printer 1128. In one or more embodiments, computer 1102 may be coupled to, or may comprise, a portable or media viewing/listening device 1132 (e.g., an MP3 player, iPod™, Nook™, portable digital video player, cellular device, personal digital assistant, etc.). In yet another embodiment, the computer 1102 may comprise a multi-touch device, mobile phone, gaming system, internet enabled television, television set top box, or other internet enabled device executing on various platforms and operating systems.

In one embodiment, the computer 1102 operates by the general purpose processor 1104A performing instructions defined by the computer program 1110 under control of an operating system 1108. The computer program 1110 and/or the operating system 1108 may be stored in the memory 1106 and may interface with the user and/or other devices to accept input and commands and, based on such input and commands and the instructions defined by the computer program 1110 and operating system 1108, to provide output and results.

Output/results may be presented on the display 1122 or provided to another device for presentation or further processing or action. In one embodiment, the display 1122 comprises a liquid crystal display (LCD) having a plurality of separately addressable liquid crystals. Alternatively, the display 1122 may comprise a light emitting diode (LED) display having clusters of red, green and blue diodes driven together to form full-color pixels. Each liquid crystal or pixel of the display 1122 changes to an opaque or translucent state to form a part of the image on the display in response to the data or information generated by the processor 1104 from the application of the instructions of the computer program 1110 and/or operating system 1108 to the input and commands. The image may be provided through a graphical user interface (GUI) module 1118. Although the GUI module 1118 is depicted as a separate module, the instructions performing the GUI functions can be resident or distributed in the operating system 1108, the computer program 1110, or implemented with special purpose memory and processors.

In one or more embodiments, the display 1122 is integrated with/into the computer 1102 and comprises a multi-touch device having a touch sensing surface (e.g., track pod or touch screen) with the ability to recognize the presence of two or more points of contact with the surface. Examples of multi-touch devices include mobile devices (e.g., iPhone™, Nexus S™, Droid™ devices, etc.), tablet computers (e.g., iPad™, HP Touchpad™), portable/handheld game/music/video player/console devices (e.g., iPod Touch™, MP3 players, Nintendo 3DS™, PlayStation Portable™, etc.), touch tables, and walls (e.g., where an image is projected through acrylic and/or glass, and the image is then backlit with LEDs).

Some or all of the operations performed by the computer 1102 according to the computer program 1110 instructions may be implemented in a special purpose processor 1104B. In this embodiment, the some or all of the computer program 1110 instructions may be implemented via firmware instructions stored in a read only memory (ROM), a programmable read only memory (PROM) or flash memory within the special purpose processor 1104B or in memory 1106. The special purpose processor 1104B may also be hardwired through circuit design to perform some or all of the operations to implement the present invention. Further, the special purpose processor 1104B may be a hybrid processor, which includes dedicated circuitry for performing a subset of functions, and other circuits for performing more general functions such as responding to computer program 1110 instructions. In one embodiment, the special purpose processor 1104B is an application specific integrated circuit (ASIC).

The computer 1102 may also implement a compiler 1112 that allows an application or computer program 1110 written in a programming language such as COBOL, Pascal, C++, FORTRAN, or other language to be translated into processor 1104 readable code. Alternatively, the compiler 1112 may be an interpreter that executes instructions/source code directly, translates source code into an intermediate representation that is executed, or that executes stored precompiled code. Such source code may be written in a variety of programming languages such as Java™, Perl™, Basic™, etc. After completion, the application or computer program 1110 accesses and manipulates data accepted from I/O devices and stored in the memory 1106 of the computer 1102 using the relationships and logic that were generated using the compiler 1112.

The computer 1102 also optionally comprises an external communication device such as a modem, satellite link, Ethernet card, or other device for accepting input from, and providing output to, other computers 1102.

In one embodiment, instructions implementing the operating system 1108, the computer program 1110, and the compiler 1112 are tangibly embodied in a non-transient computer-readable medium, e.g., data storage device 1120, which could include one or more fixed or removable data storage devices, such as a zip drive, floppy disc drive 1124, hard drive, CD-ROM drive, tape drive, etc. Further, the operating system 1108 and the computer program 1110 are comprised of computer program 1110 instructions which, when accessed, read and executed by the computer 1102, cause the computer 1102 to perform the steps necessary to implement and/or use the present invention or to load the program of instructions into a memory 1106, thus creating a special purpose data structure causing the computer 1102 to operate as a specially programmed computer executing the method steps described herein. Computer program 1110 and/or operating instructions may also be tangibly embodied in memory 1106 and/or data communications devices 1130, thereby making a computer program product or article of manufacture according to the invention. As such, the terms "article of manufacture," "program storage device," and "computer program product," as used herein, are intended to encompass a computer program accessible from any computer readable device or media.

Of course, those skilled in the art will recognize that any combination of the above components, or any number of different components, peripherals, and other devices, may be used with the computer 1102.

Figure 12:
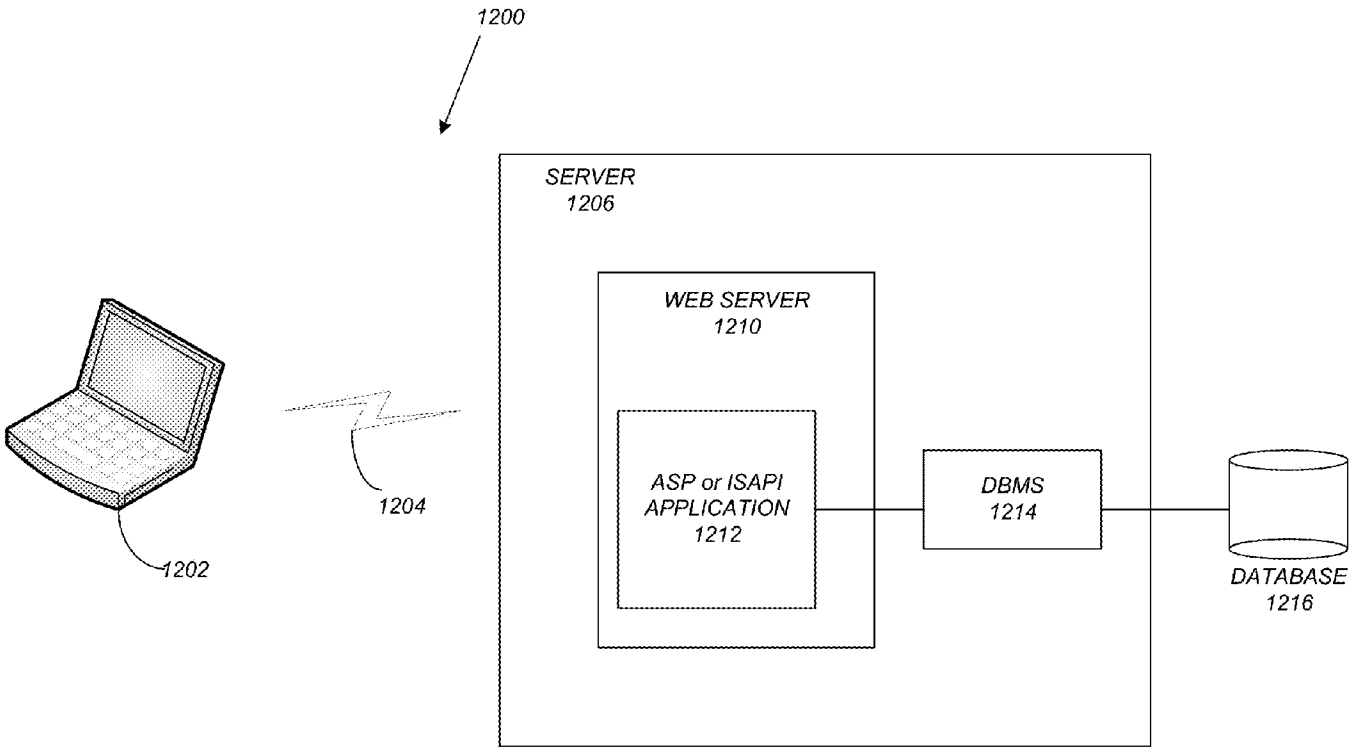
FIG. 12 schematically illustrates a typical distributed computer system using a network to connect client computers to server computers in accordance with one or more embodiments of the invention.

FIG. 12 schematically illustrates a typical distributed computer system 1200 using a network 1204 to connect client computers 1202 to server computers 1206. A typical combination of resources may include a network 1204 comprising the Internet, LANs (local area networks), WANs (wide area networks), SNA (systems network architecture) networks, or the like, clients 1202 that are personal computers or workstations (as set forth in FIGS. 1, 2, and 11), and servers 1206 that are personal computers, workstations, minicomputers, or mainframes (as set forth in FIGS. 1, 2, and 11). However, it may be noted that different networks such as a cellular network (e.g., GSM [global system for mobile communications] or otherwise), a satellite based network, or any other type of network may be used to connect clients 1202 and servers 1206 in accordance with embodiments of the invention.

A network 1204 such as the Internet connects clients 1202 to server computers 1206. Network 1204 may utilize ethernet, coaxial cable, wireless communications, radio frequency (RF), etc. to connect and provide the communication between clients 1202 and servers 1206. Clients 1202 may execute a client application or web browser and communicate with server computers 1206 executing web servers 1210. Such a web browser is typically a program such as MICROSOFT INTERNET EXPLORER™, MOZILLA FIREFOX™ OPERA™ APPLE SAFARI™, GOOGLE CHROME™, etc. Further, the software executing on clients 1202 may be downloaded from server computer 1206 to client computers 1202 and installed as a plug-in or ACTIVEX™ control of a web browser. Accordingly, clients 1202 may utilize ACTIVEX™ components/component object model (COM) or distributed COM (DCOM) components to provide a user interface on a display of client 1202. The web server 1210 is typically a program such as MICROSOFT'S INTERNET INFORMATION SERVER™.

Web server 1210 may host an Active Server Page (ASP) or Internet Server Application Programming Interface (ISAPI) application 1212, which may be executing scripts. The scripts invoke objects that execute business logic (referred to as business objects). The business objects then manipulate data in database 1216 through a database management system (DBMS) 1214. Alternatively, database 1216 may be part of, or connected directly to, client 1202 instead of communicating/obtaining the information from database 1216 across network 1204. When a developer encapsulates the business functionality into objects, the system may be referred to as a component object model (COM) system. Accordingly, the scripts executing on web server 1210 (and/or application 1212) invoke COM objects that implement the business logic. Further, server 1206 may utilize MICROSOFT'S™ Transaction Server (MTS) to access required data stored in database 1216 via an interface such as ADO (Active Data Objects), OLE DB (Object Linking and Embedding DataBase), or ODBC (Open DataBase Connectivity).

Generally, these components 1200-1216 all comprise logic and/or data that is embodied in/or retrievable from device, medium, signal, or carrier, e.g., a data storage device, a data communications device, a remote computer or device coupled to the computer via a network or via another data communications device, etc. Moreover, this logic and/or data, when read, executed, and/or interpreted, results in the steps necessary to implement and/or use the present invention being performed.

Although the terms "user computer", "client computer", and/or "server computer" are referred to herein, it is understood that such computers 1202 and 1206 may be interchangeable and may further include thin client devices with limited or full processing capabilities, portable devices such as cell phones, notebook computers, pocket computers, multi-touch devices, and/or any other devices with suitable processing, communication, and input/output capability.

Of course, those skilled in the art will recognize that any combination of the above components, or any number of different components, peripherals, and other devices, may be used with computers 1202 and 1206.

Embodiments of the invention are implemented as a software application on a client 1202 or server computer 1206. Further, as described above, the client 1202 or server computer 1206 may comprise a thin client device or a portable device that has a multi-touch-based display.

Logical Flow

Figure 13:
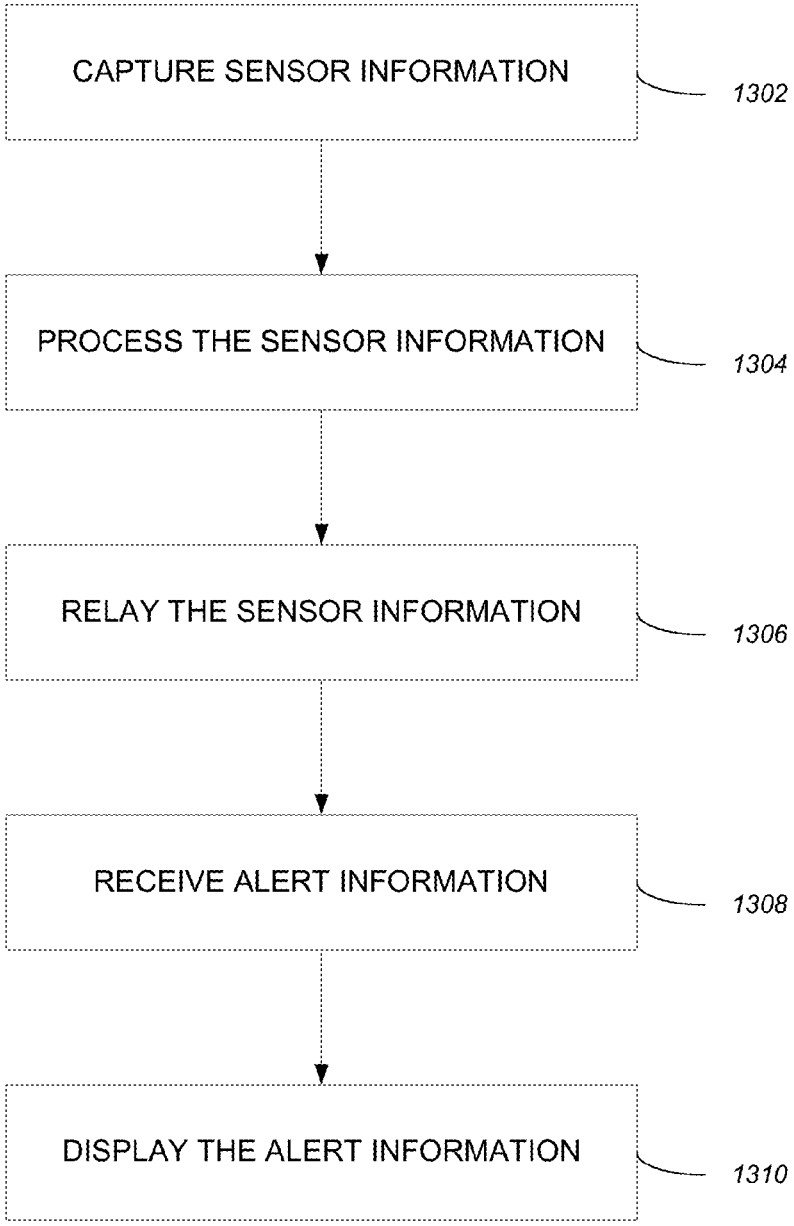
FIG. 13 is a flow chart illustrating the logical flow for tracking a position of one or more nodes in accordance with one or more embodiments of the invention.

FIG. 13 is a flow chart illustrating the logical flow for tracking a position of one or more nodes in accordance with one or more embodiments of the invention.

At step 1302, sensor information is captured from one or more sensors. Such sensor information may include a location (e.g., from a GPS module), a temperature (e.g., from a temperature sensor), and movement information (e.g., based on an accelerometer). The movement information (e.g., indicating a free-fall or extended period of inactivity) may trigger an alert condition.

At step 1304, the sensor information is processed.

At step 1306, the sensor information is relayed from the one or more nodes to a command center using a multi-hop packet routing protocol (e.g., that dynamically routing the sensor information through mobile sensor nodes using wireless communication to a base station node). Each node has a first radio transceiver chip that operates at a first frequency range (e.g., in the 902-928 MHz industrial, scientific, and medical (ISM) band) and a second radio transceiver chip that operates at a second frequency range (e.g., a 400 MHz licensed band). The two chips enable each of the nodes to operate as either a mobile sensor node or a relay base station node. The ISM band radio chip provides the (relay) link (e.g., 400 m) between two sensor nodes. Further, a power amplifier enables extended line-of-sight communication (i.e., increases the line-of-sight communication to 2 Km) between sensor nodes for the ISM band radio.

Frequency hopping may be used for communication within the first frequency range and the second frequency range between the one or more nodes. The GPS module may provide the time synchronization needed to maintain time slots for the frequency hopping. In other words, to operate at higher powers, the nodes may implement frequency hopping so that communication in each band is limited to a defined time duration (e.g., 40 ms). The system may further integrate the spatial multi-hopping protocol (e.g., CTP) with the frequency hopping protocol to provide a spatial multi-hopping system with a defined range (e.g., ~2 km) at each hop. Alternatively, the nodes may operate without the frequency hopping and instead may transmit power to a maximum of 1 mW (e.g., for a few hundred meters range at each hop). In view of the above, the system autonomously (e.g., without user intervention) routes the sensor information and alert information via a self-organizing network. For example, a node may collect temperature, acceleration, and the GPS location to signal a downed first responder without user intervention.

The command center receives the sensor information from the nodes, transmits the alert information (e.g., text message and/or audible/visual alarm) to the nodes, and may also be configured to display the sensor information overlaid on a map (e.g., on a web browser based graphical user interface). Thus, the status of first responders may be visualized on command computers, a web browser, portable tablets, etc.

At step 1308, alert information (e.g., a text message) is received from the command center.

At step 1310, the alert information is displayed on a display. Alternatively, the alert information may be audible and/or visible alarms (e.g., blinking light).

As described above, the first radio transceiver chip, the second radio transceiver chip, the power amplifier, and the one or more sensors are integrated into a single circuit board. Further, the display, alert switch, alert LED, and mating extension headers may be housed on a separate daughter board. A node may also have a connector to enable USB communication via serial-USB cable.

In view of the above, first responders are empowered with real-time data fusion and situational awareness from a heterogeneous network of sensors. Active surveillance of relevant information for each first responders is conducted and there is collaborative sharing of all information between multiple front line organizations. Geospatial mapping and the fusion of multiple sensor web information are used. Further, real-time visualization of sensor information may be provided on portable devices (e.g., on a laptop and/or on the node display). In this regard, embodiments of the invention may also provide the capability to connect a node to an external cell phone (or laptop/tablet) display using Bluetooth (or other communication methods). Once connected, alert messages from the node can be displayed on a selected Bluetooth device.

Conclusion

This concludes the description of the preferred embodiment of the invention. The following describes some alternative embodiments for accomplishing the present invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

References

[1] O. Gnawali, R. Fonseca, K. Jamieson, D. Moss, and P. Levis, "Collection Tree Protocol," in *Proceedings of the 7th ACM Conference on Embedded Networked Sensor Systems* (*SenSys*), 2009.

[2] P. Levis and G. Tolle, "Dissemination of Small Values," in *TinyOS Enhancement Proposals.*

What is claimed is:

1. A personal alert and tracking system comprising one or more nodes, wherein each of the one or more nodes comprises:

(a) a first radio transceiver chip operating at a first frequency range and a second radio transceiver chip operating in a second frequency range, wherein:

(1) the first radio transceiver chip and the second radio transceiver chip enable the node to operate as either a mobile sensor node or a relay base station node;

(2) the second radio transceiver chip provides a relay link between the one or more nodes;

(b) a power amplifier that increases a line-of-sight communication between the one or more nodes;

(c) one or more sensors for providing sensor information, wherein the one or more sensors comprise:

(1) a global positioning system (GPS) module for providing a location;

(2) a temperature sensor for determining a temperature; and (3) an accelerometer for triggering an alert condition;

(d) a first display for displaying alert information;

(e) embedded software configured to:

(1) capture and process the sensor information;

(2) provide a multi-hop packet routing protocol to relay the sensor information to a command center;

(3) receive alert information from the command center; and (4) display the alert information on the display.

2. The personal alert and tracking system of claim 1, wherein the first frequency range comprises a 902-928 MHz industrial, scientific, and medical (ISM) band.

3. The personal alert and tracking system of claim 1, wherein the second frequency range comprises a 400 MHz licensed band.

4. The personal alert and tracking system of claim 1, wherein frequency hopping is used for communication within the first frequency range and the second frequency range between the one or more nodes.

5. The personal alert and tracking system of claim 4, wherein the GPS module provides time synchronization needed to maintain time slots for the frequency hopping.

6. The personal alert and tracking system of claim 1, wherein the alert condition comprises a free-fall or extended period of inactivity.

7. The personal alert and tracking system of claim 1, wherein the alert information comprises a text message.

8. The personal alert and tracking system of claim 1, wherein:

the first radio transceiver chip, the second radio transceiver chip, the power amplifier, and the one or more sensors are integrated into a single circuit board; and the display is housed on a separate daughter board.

9. The personal alert and tracking system of claim 1, wherein the multi-hop packet routing protocol comprises dynamically routing the sensor information through the one or more mobile sensor nodes using wireless communication to a base station node.

10. The personal alert and tracking system of claim 1, wherein the command center is configured to:

receive the sensor information from the one or more nodes;

transmit the alert information to the one or more nodes; and display the sensor information overlaid on a map.

11. The personal alert and tracking system of claim 10, wherein the display is performed on a web browser based graphical user interface.

12. The personal alert and tracking system of claim 1, wherein the system autonomously routes the sensor information and alert information via a self-organizing network.

13. A method for tracking a position of one or more nodes comprising:

(a) capturing sensor information from one or more sensors by:

(1) determining a location from a global positioning system (GPS) module;

(2) determining a temperature using a temperature sensor; and (3) determining movement information based on an accelerometer;

(b) processing the sensor information;

(c) relaying the sensor information from one or more nodes to a command center using a multi-hop packet routing protocol, wherein:

(1) each node has a first radio transceiver chip that operates at a first frequency range;

(2) each node has a second radio transceiver chip that operates at a second frequency range;

(3) the first radio transceiver chip and the second radio transceiver chip enable each of the nodes to operate as either a mobile sensor node or a relay base station node;

(4) the second radio transceiver chip provides a relay link between the one or more nodes;

(5) a power amplifier increases a line-of-sight communication between the one or more nodes;

(d) receiving alert information from the command center; and (e) displaying the alert information on a display.

14. The method of claim 13, wherein the first frequency range comprises a 902-928 MHz industrial, scientific, and medical (ISM) band.

15. The method of claim 13, wherein the second frequency range comprises a 400 MHz licensed band.

16. The method of claim 13, wherein frequency hopping is used for communication within the first frequency range and the second frequency range between the one or more nodes.

17. The method of claim 16, wherein the GPS module provides time synchronization needed to maintain time slots for the frequency hopping.

18. The method of claim 13, further comprising triggering, via the movement information indicating a free-fall or extended period of inactivity, an alert condition.

19. The method of claim 13, wherein the alert information comprises a text message.

20. The method of claim 13, wherein:

the first radio transceiver chip, the second radio transceiver chip, the power amplifier, and the one or more sensors are integrated into a single circuit board; and the display is housed on a separate daughter board.

21. The method of claim 13, wherein the multi-hop packet routing protocol comprises dynamically routing the sensor information through the one or more mobile sensor nodes using wireless communication to a base station node.

22. The method of claim 13, wherein the command center is configured to:

receive the sensor information from the one or more nodes;

transmit the alert information to the one or more nodes; and display the sensor information overlaid on a map.

23. The method of claim 22, wherein the display of the sensor information is performed on a web browser based graphical user interface.

24. The method of claim 13, wherein the system autonomously routes the sensor information and alert information via a self-organizing network.

* * * * *